US010560782B2

(12) United States Patent
Abe et al.

(10) Patent No.: US 10,560,782 B2
(45) Date of Patent: Feb. 11, 2020

(54) SIGNAL PROCESSOR

(71) Applicant: SOCIONEXT INC., Kanagawa (JP)

(72) Inventors: Kazutaka Abe, Yokohama (JP); Shuji Miyasaka, Yokohama (JP)

(73) Assignee: SOCIONEXT INC, Kanagawa (JP)

( * ) Notice: Subject to any disclaimer, the term of this patent is extended or adjusted under 35 U.S.C. 154(b) by 0 days.

(21) Appl. No.: 16/160,791

(22) Filed: Oct. 15, 2018

(65) Prior Publication Data

US 2019/0052962 A1 Feb. 14, 2019

Related U.S. Application Data

(63) Continuation of application No. PCT/JP2017/014288, filed on Apr. 5, 2017.

(30) Foreign Application Priority Data

Apr. 21, 2016 (JP) ..... 2016-085520

(51) Int. Cl.
*H04R 3/14* (2006.01)
*H04S 1/00* (2006.01)
*H04R 3/04* (2006.01)

(52) U.S. Cl.
CPC ..... *H04R 3/14* (2013.01); *H04R 3/04* (2013.01); *H04S 1/00* (2013.01)

(58) Field of Classification Search
CPC .... H04S 5/00; H04S 1/00; H04R 3/14; H04R 3/04
See application file for complete search history.

(56) References Cited

U.S. PATENT DOCUMENTS 4,219,696 A * 8/1980 Kogure ..... H04S 5/00 381/1
4,555,795 A * 11/1985 Bedini ..... H04S 5/00 330/59

(Continued)

FOREIGN PATENT DOCUMENTS

JP H08-182100 A 7/1996
JP 2001-346298 A 12/2001

(Continued)

OTHER PUBLICATIONS

International Search Report issued in International Application No. PCT/JP2017/014288 dated Jun. 27, 2017.

(Continued)

*Primary Examiner* — Jason R Kurr
(74) *Attorney, Agent, or Firm* — McDermott Will & Emery LLP

(57) ABSTRACT

A signal processor that performs crosstalk cancellation on an audio signal that is input, in a distorted acoustic space where two speakers are placed, the two speakers including an X-side speaker and a Y-side speaker, where X denotes one of left and right, and Y denotes the other of left and right. The signal processor causes the Y-side speaker to output a sound of the audio signal and causes the X-side speaker to output a sound of a signal obtained by processing the audio signal using transfer function GCY, where a transfer function between the Y-side speaker and the Y-side ear is defined as GYY, a transfer function between the X-side speaker and the Y-side ear is defined as GXY, and a transfer function obtained by dividing the transfer function GYY by the transfer function GXY is defined as GCY.

9 Claims, 23 Drawing Sheets

(56) References Cited

U.S. PATENT DOCUMENTS

| | | | | |
|---|---|---|---|---|
| 5,666,425 | A | 9/1997 | Sibbald et al. | |
| 6,442,277 | B1 * | 8/2002 | Lueck | H04S 5/00 381/1 |
| 6,956,954 | B1 | 10/2005 | Takemura et al. | |
| 2007/0223750 | A1 * | 9/2007 | Bai | H04S 1/002 381/309 |
| 2008/0031462 | A1 * | 2/2008 | Walsh | H04S 3/02 381/17 |
| 2009/0086982 | A1 * | 4/2009 | Kulkarni | H04R 5/04 381/1 |
| 2010/0303245 | A1 * | 12/2010 | Vickers | H04S 1/005 381/17 |
| 2017/0034623 | A1 | 2/2017 | Christoph et al. | |

FOREIGN PATENT DOCUMENTS

| | | | |
|---|---|---|---|
| JP | 2006-303799 | A | 11/2006 |
| WO | 00/24226 | A1 | 4/2000 |
| WO | 2008/152720 | A1 | 12/2008 |
| WO | 2015/154986 | A1 | 10/2015 |

OTHER PUBLICATIONS

Wiliam G Gardner: "3-D Audio Using Loudspeakers," Massachusetts Institute of Technology, XP055098835; Retrieved from the Internet: URL:http://sound.media.mit.edu/Papers/gardner_thesis.pdf; Sep. 1, 1997; pp. 1-153.

Extended European Search Report issued in European Patent Application No. 17785804.0, dated Nov. 26, 2019.

* cited by examiner

FIG. 13

| no | Upper edge of critical band [Hz] |
|---|---|
| 0 | 93,75 |
| 1 | 218,75 |
| 2 | 312,50 |
| 3 | 406,25 |
| 4 | 531,25 |
| 5 | 656,25 |
| 6 | 781,25 |
| 7 | 937,50 |
| 8 | 1093,75 |
| 9 | 1250,00 |
| 10 | 1468,75 |
| 11 | 1687,50 |
| 12 | 1937,50 |
| 13 | 2312,50 |
| 14 | 2687,50 |
| 15 | 3250,00 |
| 16 | 3875,00 |
| 17 | 4500,00 |
| 18 | 5375,00 |
| 19 | 6375,00 |
| 20 | 7500,00 |

SIGNAL PROCESSOR

CROSS REFERENCE TO RELATED APPLICATIONS

This is a continuation application of PCT International Application No. PCT/JP2017/014288 filed on Apr. 5, 2017, designating the United States of America, which is based on and claims priority of Japanese Patent Application No. 2016-085520 filed on Apr. 21, 2016. The entire disclosures of the above-identified applications, including the specifications, drawings and claims are incorporated herein by reference in their entirety.

FIELD

The present disclosure relates to a signal processor equipped with a crosstalk canceller.

BACKGROUND

Multi-channel audio signals such as those for 5.1ch or 7.1ch have become widely used not only for movies and music but also for games. The reproduction of audio signals using multi-channel speakers placed in predetermined positions surrounding a listener realizes audio reproduction that gives realistic sensation to the listener. However, it is difficult, in terms of space in many cases, to place multi-channel speakers of 5.1ch or 7.1ch at home. In view of the above, 3D acoustic technology that realizes quasi-acoustic effects identical to those produced by multi-channel audio reproduction using conventional stereo speakers has been developed.

For example, Patent Literature (PTL) 1 discloses a sound image localization apparatus that localizes a sound image at an arbitrary position by three-dimensional sound field processing. Moreover, PTL 2 discloses an acoustic signal reproducing apparatus that widens a sound image of a signal and thus reproduces the signal.

CITATION LIST

Patent Literature

[PTL 1] Japanese Unexamined Patent Application Publication No. H8-182100

[PTL 2] Japanese Unexamined Patent Application Publication No. 2006-303799

SUMMARY

Technical Problem

In the crosstalk cancellation as disclosed in PTL 1, the problem is that an inappropriate phenomenon such that a listener hears a sound greater than a sound that is originally desired to be heard by the listener can happen in a distorted acoustic space.

Here, crosstalk cancellation is to control the sounds to be output from two speakers so that a sound of an audio signal is substantially cancelled at one of the ears of a listener. Moreover, a distorted acoustic space refers, for example, to an acoustic space in which two speakers are asymmetrically placed relative to a listener. More specifically, a relationship between two speakers embedded in both right and left doors inside a vehicle and a listener in a driver's seat (or the front passenger seat) is one example of the distorted acoustic space.

The present disclosure has an object to provide a signal processor that realizes appropriate crosstalk cancellation even in a distorted acoustic space.

Solution to Problem

In order to solve the above-described problem, a signal processor according to one aspect of the present disclosure is a signal processor that performs crosstalk cancellation on an audio signal that is input, in a distorted acoustic space where two speakers are placed, the two speakers including an X-side speaker placed on an X-side of a listener and a Y-side speaker placed on a Y-side of the listener, where X denotes one of left and right, and Y denotes the other of left and right. The signal processor includes a controller that controls sounds to be output from the two speakers so that a sound of the audio signal is substantially cancelled at a Y-side ear that is a listener's ear on the Y-side. The controller causes the Y-side speaker to output a sound of the audio signal and causes the X-side speaker to output a sound of a signal obtained by processing the audio signal using transfer function GCY, where a transfer function between the Y-side speaker and the Y-side ear is defined as GYY, a transfer function between the X-side speaker and the Y-side ear is defined as GXY, and a transfer function obtained by dividing the transfer function GYY by the transfer function GXY is defined as GCY.

With this configuration, it is possible, in a distorted acoustic space, to cancel crosstalk without increasing the gain of a crosstalk canceller. Accordingly, it is possible, even in a distorted acoustic space, to reduce the inappropriate phenomenon such that a listener hears a sound greater than a sound that is originally desired to be heard by the listener. In other words, appropriate crosstalk cancellation can be realized.

Moreover, the controller further transforms the audio signal into frequency band signals F(n), where n denotes an index indicating each frequency band, compares, for each frequency band indicated by n, a gain of transfer function GYY(n) with a gain of transfer function GXY(n), causes the Y-side speaker to output a sound of one of the frequency band signals F(n) and causes the X-side speaker to output a sound of a signal obtained by processing the one of the frequency band signals F(n) using transfer function GCY(n), when the gain of the transfer function GXY(n) is greater than the gain of the transfer function GYY(n), and causes the X-side speaker to output the sound of the one of the frequency band signals F(n) and causes the Y-side speaker to output a sound of a signal obtained by processing the one of the frequency band signals F(n) using transfer function GCX(n), when the gain of the transfer function GYY(n) is greater than the gain of the transfer function GXY(n), where for each frequency band indicated by n: a transfer function between the Y-side speaker and the Y-side ear is defined as GYY(n); a transfer function between the X-side speaker and the Y-side ear is defined as GXY(n); a transfer function obtained by dividing the transfer function GYY(n) by the transfer function GXY(n) is defined as GCY(n); and a transfer function obtained by dividing the transfer function GXY(n) by the transfer function GYY(n) is defined as GCX(n).

This allows the signal processor to determine, for each frequency band, the degree of distortion in an acoustic space, and provide, for each frequency band, appropriate settings about which of the speakers should play an audio signal and which of the speakers should play the cancelling sound thereof (i.e., select, for each frequency band, a speaker adapted to small gains). It is therefore possible to use a crosstalk canceller that is optimum for various acoustic spatial characteristics.

Moreover, the signal processor further includes a delayer that delays the audio signal that is input, and a delay time caused by the delayer is set to satisfy a causality between sound output from the X-side speaker and sound output from the Y-side speaker.

With this, even if a designed transfer function did not have any time-advance components and thereby did not satisfy the causality between the two sound outputs, it is possible to satisfy the causality by a delay time caused by the delayer.

Advantageous Effects

According to the present disclosure, it is possible, even in an acoustically distorted space, to reduce the gain of a control sound for cancelling crosstalk, more assuredly reduce the inappropriate phenomenon such that a listener hears a sound greater than a sound that is originally desired to be heard by the listener, and realize crosstalk cancellation that is highly resistant to change in acoustic characteristics.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

FIG. 13 is a diagram illustrating examples of critical bands.

DESCRIPTION OF EMBODIMENTS (Underlying Knowledge Forming Basis of the Present Disclosure)

The inventors of the present disclosure have discovered that the following problems related to crosstalk cancellation as described in the section of "Background Art" rise. This point will be described with reference to FIG. 8 through FIG. 11C illustrating comparison examples.

It is general to use a crosstalk canceller in 3D acoustic technology utilizing stereo speakers. Crosstalk canceller is a signal processor designed to cancel a sound that is output from a speaker installed on the left side of the listener and that reaches the right ear of a listener, using a control sound emitted from a speaker installed on the right side of the listener (or to cancel a sound that is output from a speaker installed on the right side of the listener and that reaches the left ear of the listener).

Figure 8:
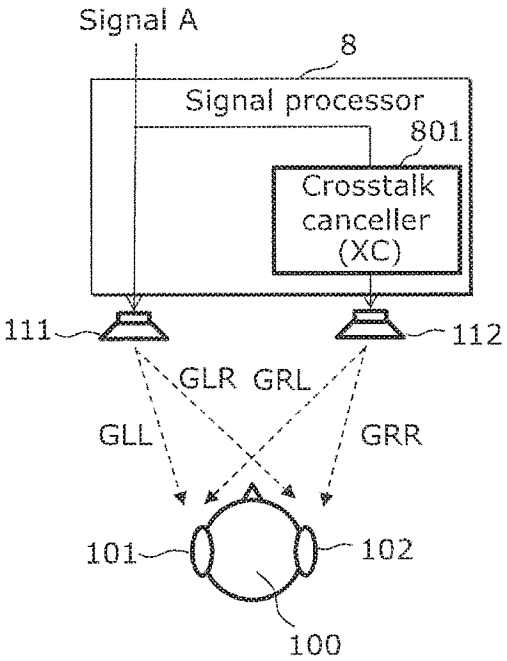
FIG. 8 is a diagram illustrating an example, shown for comparison, of the configuration of a signal processor that includes a crosstalk canceller and speakers, and a listener.

First, the mechanism of a crosstalk canceller utilizing stereo speakers will be described with reference to FIG. 8. FIG. 8 is a diagram illustrating an example, shown for comparison, of the configuration of signal processor 8 that includes crosstalk canceller 801, speakers, and listener 100. Signal processor 8 includes crosstalk canceller 801 and is connected to speakers 111 and 112. Note that all of variables shall be values transformed into frequency domain in the case where no mention is particularly made in the description of this specification. Moreover, a transfer function from left speaker 111 to left ear 101 of listener 100 is referred to as GLL and a transfer function from left speaker 111 to right ear 102 of listener 100 is referred to as GLR, a transfer function from right speaker 112 to left ear 101 of listener 100 is referred to as GRL, and a transfer function from right speaker 112 to right ear 102 of listener 100 is referred to as GRR. In addition, listener 100 is a person who actually listens to sound being played back, but may be a mannequin (dummy head) that is intended for acoustic measurement and has an average head shape. Moreover, left speaker 111 and right speaker 112 are speakers that are placed on left and right sides relative to the front of listener 100 and on a horizontal plane at the level of the ears of listener 100, but shall not be restricted to such and need not be placed on the horizontal plane.

In FIG. 8, the signals obtained at left ear 101 and right ear 102 of listener 100 are controlled using speakers 111 and 112 which are stereo speakers. Note that "ear" means a place near the entrance of external acoustic meatus of a listener, but may be anywhere near the ear where acoustic characteristics can be perceived, e.g., location of ear drum.

Here, signal A is input and a sound reaches left ear 101 and 0 (i.e., a state in which a sound does not reach) is realized at right ear 102. In other words, leaking (crosstalk) of sound from speaker 111 to right ear 102 is cancelled. This is realized using crosstalk canceller 801. Transfer function of crosstalk canceller 801 is defined as XC. When an acoustic transfer function from speaker 111 to left ear 102 is defined as GLL, an acoustic transfer function from speaker 111 to right ear 102 is defined as GLR, an acoustic transfer function from speaker 112 to left ear 101 is defined as GRL, and an acoustic transfer function from speaker 112 to right ear 102 is defined as GRR, Formula 1 needs to be satisfied in order to gain 0 at right ear 102.

$$(GLR+XC*GRR)*A=0 \quad \text{(Formula 1)}$$

In other words, transfer function XC of crosstalk canceller 801 is realized by Formula 2.

$$XC=-GLR/GRR \quad \text{(Formula 2)}$$

Reproduction, by speakers 111 and 112, of the signals that have been processed using crosstalk canceller 801 thus designed realizes the state in which a sound of signal A reaches only left ear 101 of listener 100 and does not reach right ear 102.

Here, as shown in FIG. 8, when speakers 111 and 112 are symmetrically placed relative to listener 100, the distance between left speaker 111 and right ear 102 is longer than the distance between right speaker 112 and right ear 102. Moreover, right speaker 112 is placed in a position visible from the position of right ear 102, but left speaker 111 is not in such a position, and therefore, a sound from left speaker 111 comes all the way to reach right ear 102. Based on these, $|GLR|<|GRR|$ is satisfied as a result of comparison between the gain of GLR and the gain of GRR. The gain of transfer function XC of crosstalk canceller 801 also satisfies $|XC|<1$. Namely, the gain of a cancelling sound (i.e., control sound) that is played back by right speaker 112 becomes smaller than the gain of a sound that is originally desired to be heard by the listener and is played back by left speaker 111, which does not cause any problems. In other words, the inappropriate phenomenon such that a listener hears a sound greater than a sound that is originally desired to be heard by the listener does not happen.

Figure 9A:
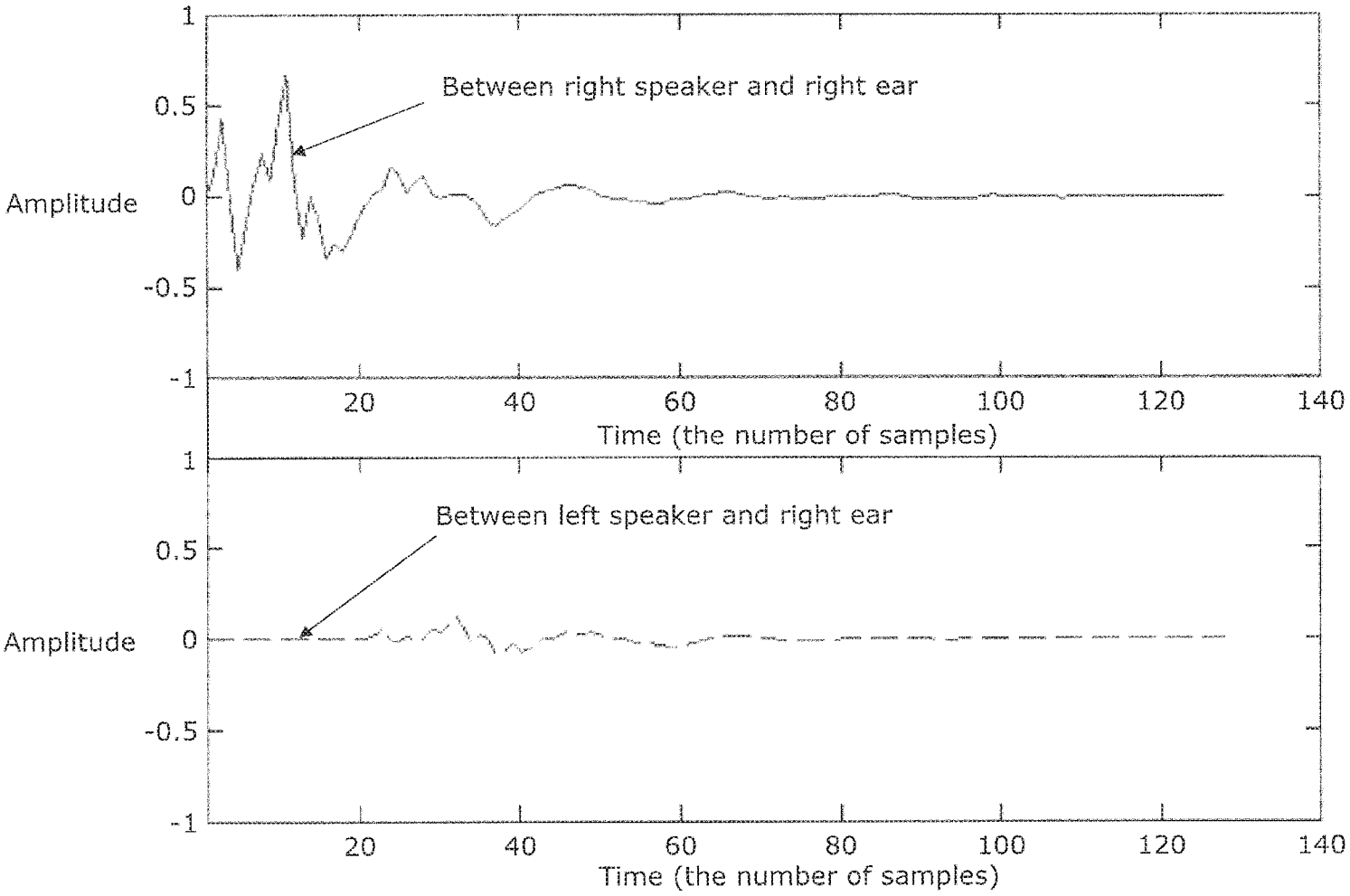
FIG. 9A is a diagram illustrating examples of impulse response measurement when speakers are placed symmetrically as illustrated in FIG. 8.
Figure 9B:
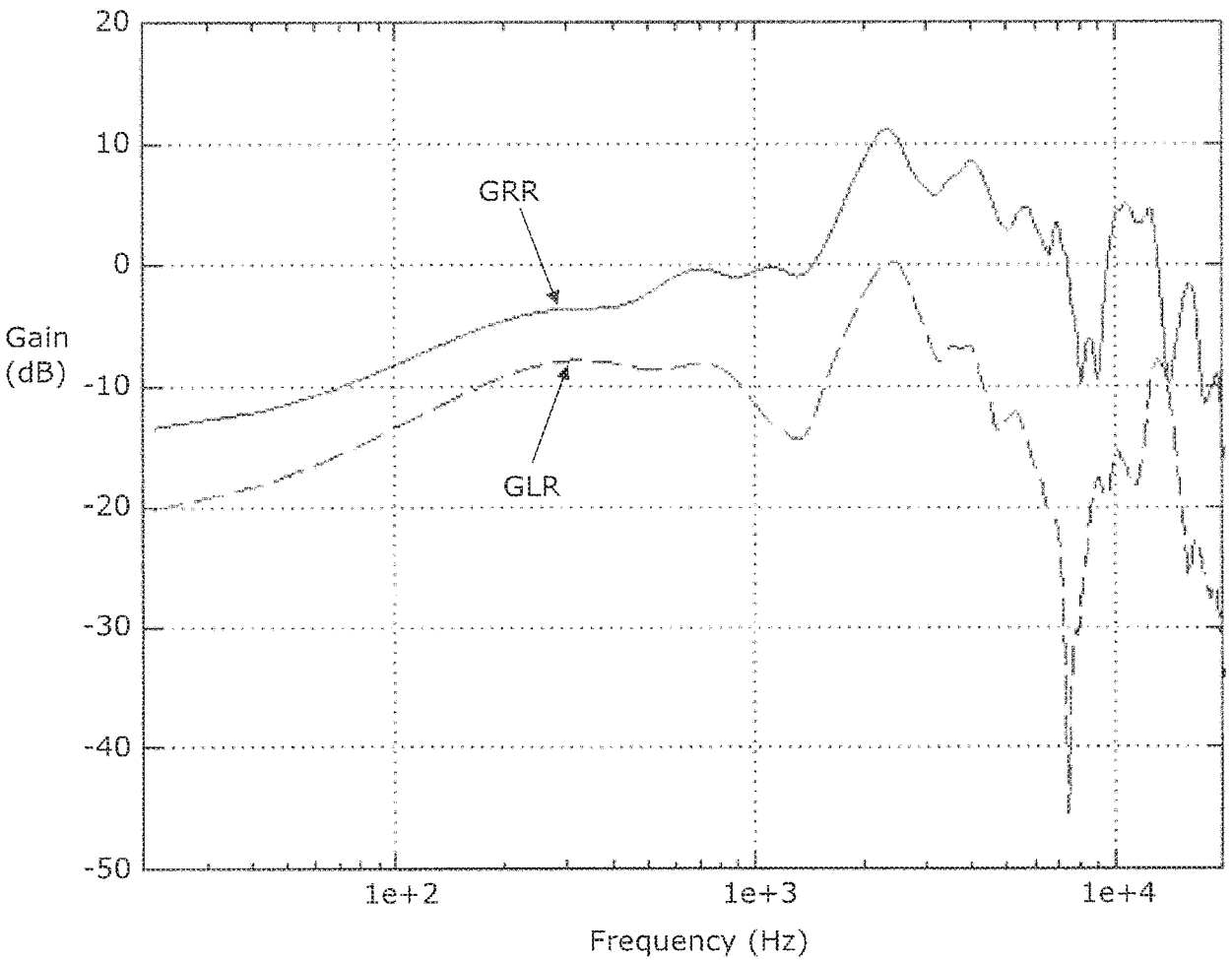
FIG. 9B is a diagram illustrating the frequency characteristics of the impulse responses shown in FIG. 9A.
Figure 9C:
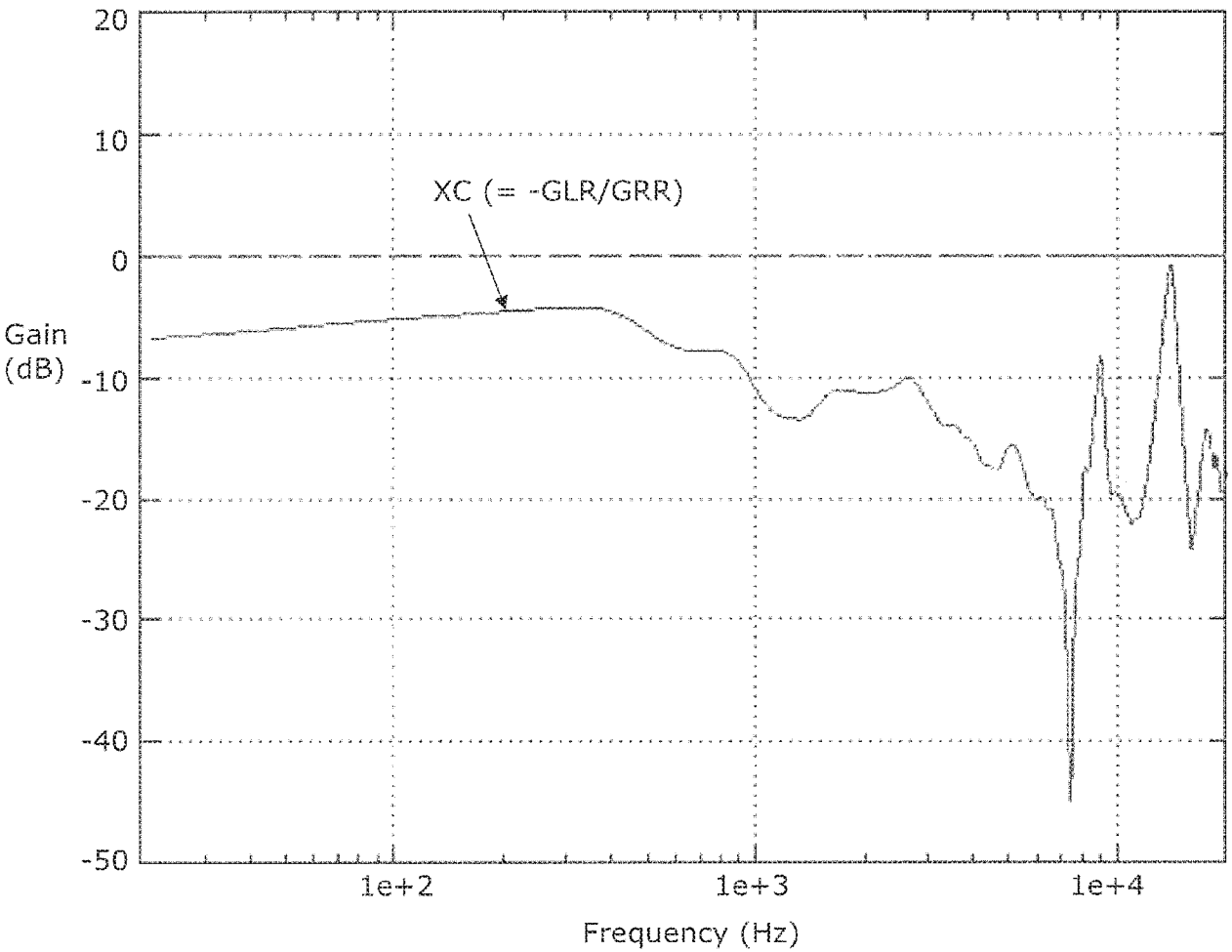
FIG. 9C is a diagram illustrating an example of the frequency characteristics of a designed crosstalk canceller.

Each of FIG. 9A through FIG. 9C illustrates a concrete example of measurement related to transfer function in the case where speakers 111 and 112 are symmetrically placed relative to listener 100. FIG. 9A is a diagram illustrating the examples of impulse response measurement when speakers are placed symmetrically as illustrated in FIG. 8. The upper graph in FIG. 9A shows an impulse response between right speaker 112 and right ear 102 whereas the lower graph shows an impulse response between left speaker 111 and right ear 102. The horizontal axis presents the number of samples corresponding to time while the vertical axis presents amplitude in the graph. As can been seen from FIG. 9A, the amplitude of the impulse response between right speaker 112 and right ear 102 is greater than that of the impulse response between left speaker 111 and right ear 102. This is attributed to the fact that the distance between right speaker 112 and right ear 102 is shorter than that between left speaker 111 and right ear 102, and right speaker 112 is located in a position visible from the position of right ear 102. FIG. 9B is a diagram illustrating the frequency characteristics of the impulse responses shown in FIG. 9A. Stated differently, FIG. 9B shows the result of Fourier transforming, into frequency domain, each of the impulse response curves shown in the upper and lower graphs in FIG. 9A. The horizontal axis presents frequency and the vertical axis presents gain by a unit dB. The solid line represents GRR and the dotted line represents GLR. The diagram shows that, even focusing on each frequency, GRR is greater than GLR. The solid line in FIG. 9C presents the result obtained by calculating transfer function XC of crosstalk canceller 801 for each frequency based on these GLR and GRR. Stated differently, FIG. 9C is a diagram illustrating an example of the frequency characteristics of designed crosstalk canceller 801. The gain of transfer function XC of crosstalk canceller 801 takes, at every frequency, a value smaller than 0 dB (sound pressure level (SPL) output) indicated by the dotted line. It is observed that right speaker 112 outputs a smaller control sound than left speaker 111. In other words, a sound desired to be heard by the listener is played back by the speaker on the side of the ear by which the sound is desired to be heard while a control sound for cancelling crosstalk is played back by the speaker on the side of the ear by which the sound is not desired to be heard. This proves that a signal for cancelling crosstalk needs to emit a sound smaller than the signal of the sound desired to be heard by the listener. Accordingly, the inappropriate phenomenon such that a listener hears a sound greater than a sound that is originally desired to be heard by the listener does not happen when the speakers are placed symmetrically.

Figure 10:
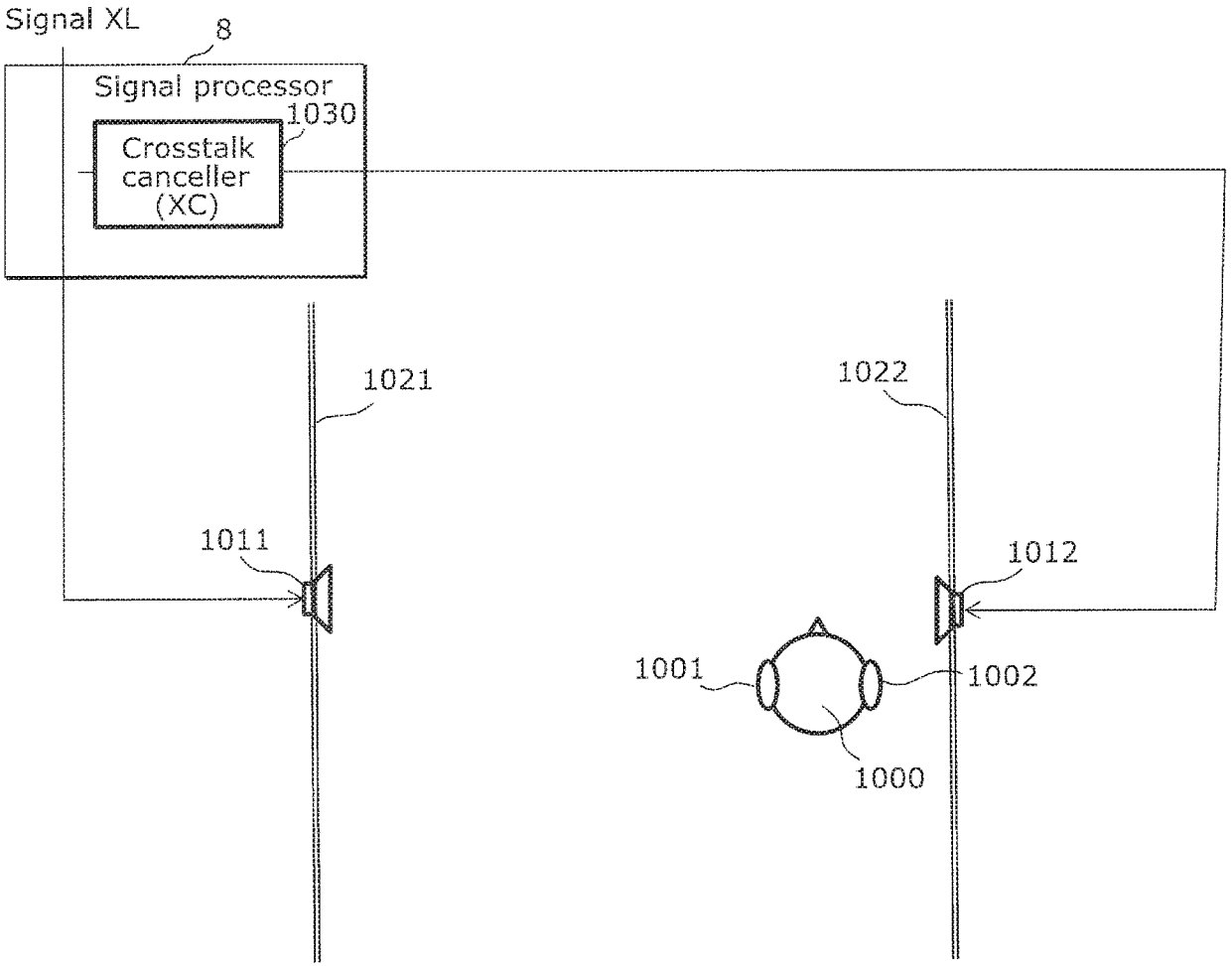
FIG. 10 is a diagram illustrating an example of the configuration of: a signal processor that includes a crosstalk canceller and is installed inside a vehicle; and the surroundings of speakers, and a listener.

The above has described the case where the speakers are placed symmetrically as illustrated in FIG. 8, but the same does not apply to the sound environment where the speakers are placed asymmetrically relative to the position of the listener. FIG. 10 illustrates a diagram showing the inside of a vehicle. FIG. 10 is a diagram illustrating an example of the configuration of: signal processor 8 that includes crosstalk canceller 1030 and is installed inside a vehicle; and the surroundings of speakers, and listener 1000. Here, the case where listener 1000 sits in the driver's seat on the right and listens to the sounds from both speakers 1011 and 1012 is taken as an example. In many cases, left and right walls 1021 and 1022 formed from windows, doors, etc. are present inside the vehicle and speakers 1011 and 1012 are installed in these left and right walls 1021 and 1022, as illustrated in FIG. 10. Moreover, speakers 1011 and 1012 are installed in walls 1021 and 1022 near the feet of listener 1000, in many cases, and right speaker 1012 is not located in a position visible from the position of right ear 1002 in some cases. What is more, a sound emitted from left speaker 1011 reaches right ear 1002 coming all the way therefrom, but in order to reach right ear 1002, it can take a path reflected by wall 1022, which includes, for example, a surface made of glass. It is therefore predictable that characteristics different from those gained in the sound environment as illustrated in FIG. 8 can be gained. Since a glass surface, in particular, has high reflectivity for sound and reflects a sound well without attenuating it, a sound conveyed to right ear 1002 from left speaker 1011 which is located further from listener 1000 is heard as a sound greater than a sound conveyed from right speaker 1012 to right ear 1002, that is, |GLR|>|GRR|, in some cases. In such an acoustic system, when transfer function XC of crosstalk canceller 1030 configured as illustrated in FIG. 10 is designed, the gain of transfer function XC is expressed by |XC|>1. Moreover, because right speaker 1012 is not located in a position visible from the position of right ear 1002, transfer function GRR representing acoustic characteristics between them has weak direct-sound components and more reflected-sound components on the whole.

In such a case, the dip of the frequency characteristics such that |GRR| becomes extremely small is generated, and this also causes |XC|, which is the gain of crosstalk canceller 1030, to be greater than 1.

Generally speaking, in order to realize crosstalk cancellation by processing an input signal using the filter (crosstalk canceller) thus designed, transfer function XC of designed crosstalk canceller 1030 is inverse Fourier transformed into time domain, and an input signal is processed using an FIR filter. Here, when XC abruptly changes depending on the frequency such that gain |XC| of transfer function XC of crosstalk canceller 1030 takes a greater value at a particular frequency, the problem is that a great number of taps is required in time domain and this increases the amount of computation. Moreover, it might worsen the state to the extent that the gain does not converge (but diverges) even with the increase in the number of taps, depending on the case. In such a case, it is not possible to realize the processing using the filter having such a characteristic.

When |XC|>1, a control sound, which is greater than a sound that is played back by left speaker 1011 and which is originally desired to be heard by the listener, is played back by right speaker 1012. The following describes the influence this can make on the crosstalk cancellation. The acoustic characteristics between left speaker 1011 and left ear 1001 of listener 1000, those between left speaker 1011 and right ear 1002 of listener 1000, those between right speaker 1012 and left ear 1001, and those between right speaker 1012 and right ear 1002 change due to various factors. For example, the position at which acoustic transfer functions between left speaker 1011 and left ear 1001, between left speaker 1011 and right ear 1002, between right speaker 1012 and left ear 1001, and between right speaker 1012 and right ear 1002 are measured may be different from the listening position of listener 1000 in some cases. In such a case, when gain |XC| of crosstalk canceller 1030 is large, influence on the signal gained at the ear when the acoustic characteristics between right speaker 1012 and right ear 1002 have slightly changed is large and it is predictable that the sound gained at right ear 1002 might greatly differ from 0. Particularly inside a vehicle, for example, where many reflected sounds are present, acoustic characteristics easily change as affected by reflected sounds caused, for example, by a little movement of the listener's head etc. Therefore, the frequency, at which the gain of the acoustic characteristics between right speaker 1012 and right ear 1002 takes a small value, easily changes. As a result, the gain cannot be successfully controlled.

Figure 11A:
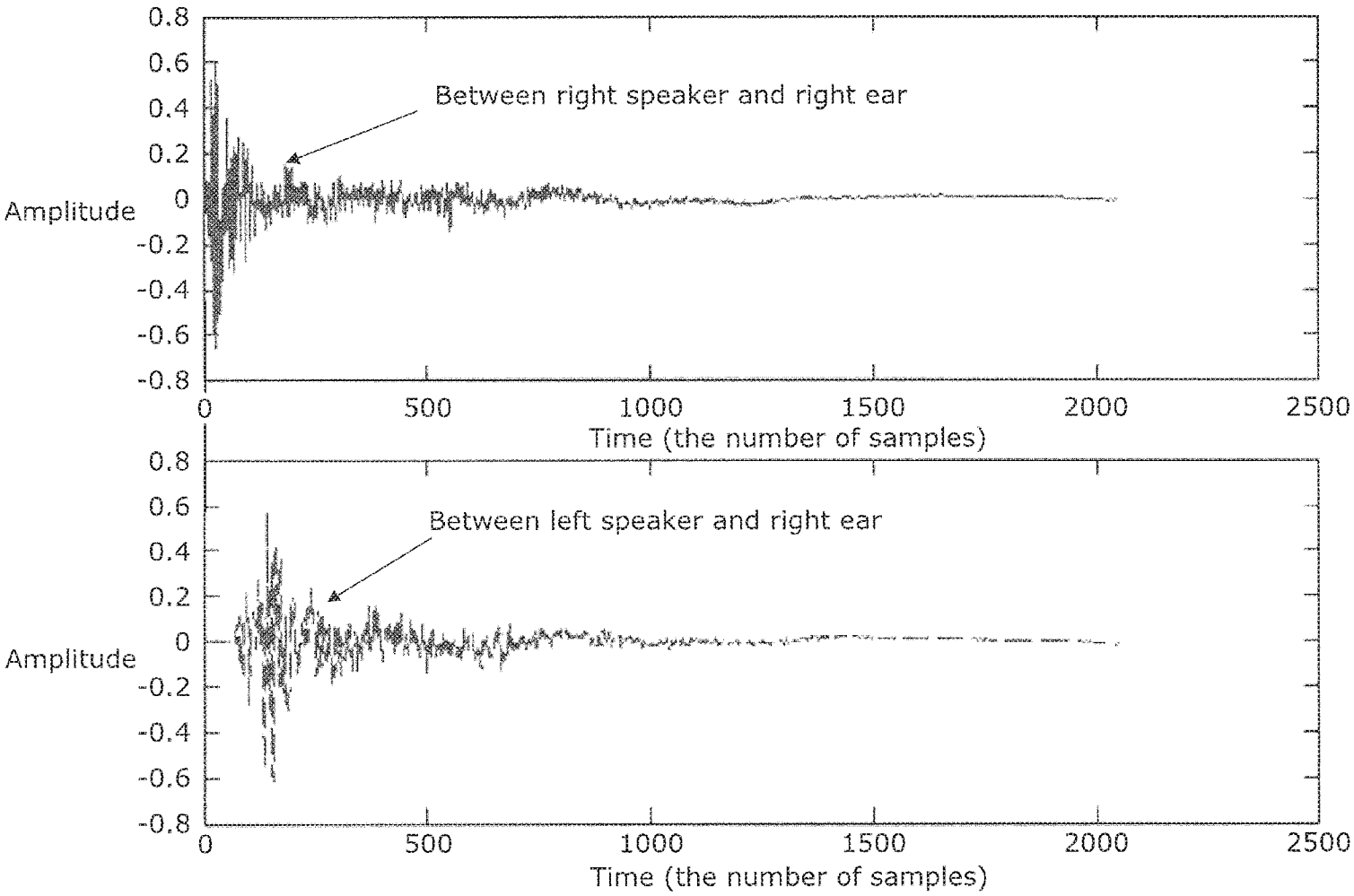
FIG. 11A is a diagram illustrating examples of impulse response measurement when speakers are placed asymmetrically as illustrated in FIG. 10.
Figure 11B:
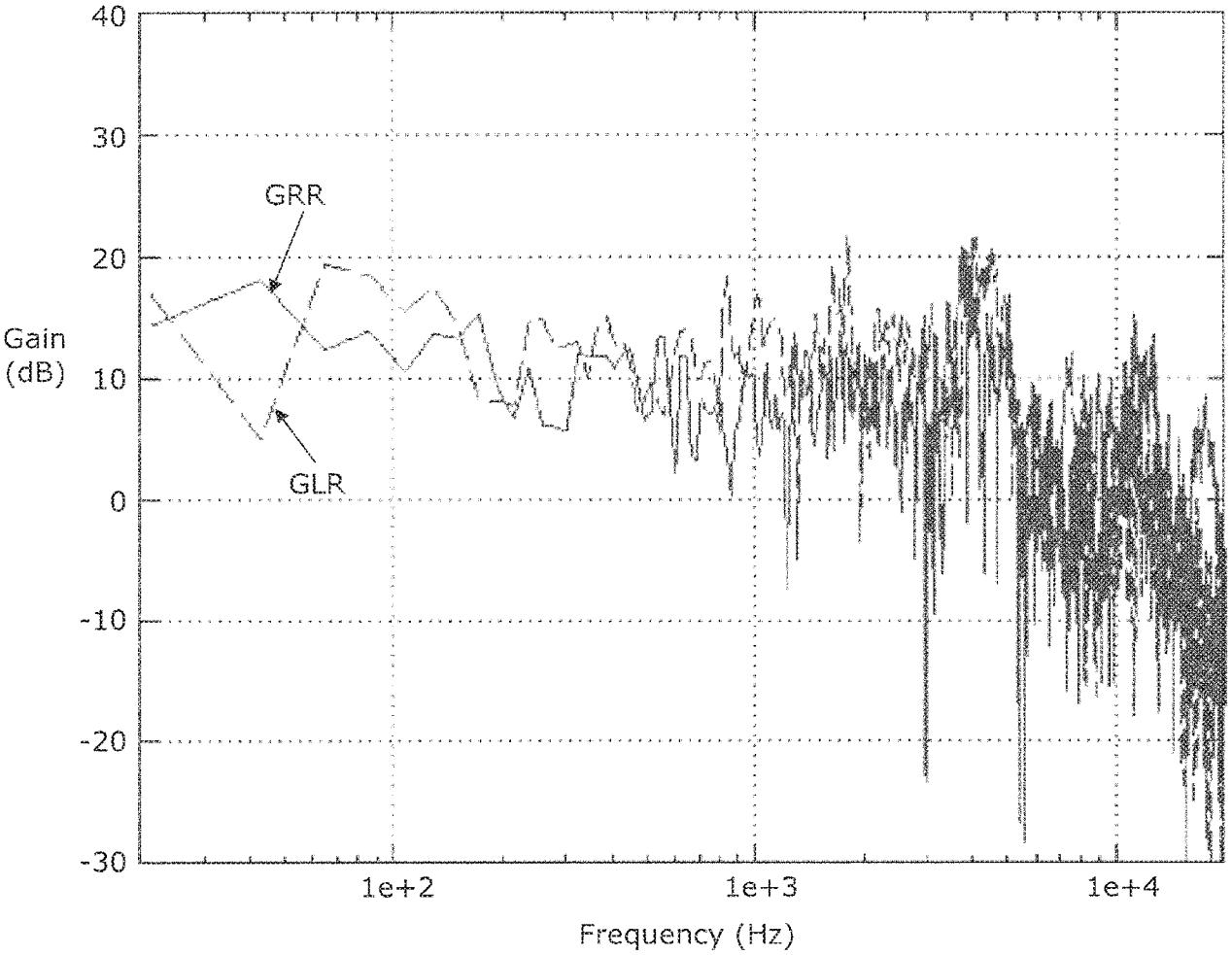
FIG. 11B is a diagram illustrating the frequency characteristics of the impulse responses shown in FIG. 11A.
Figure 11C:
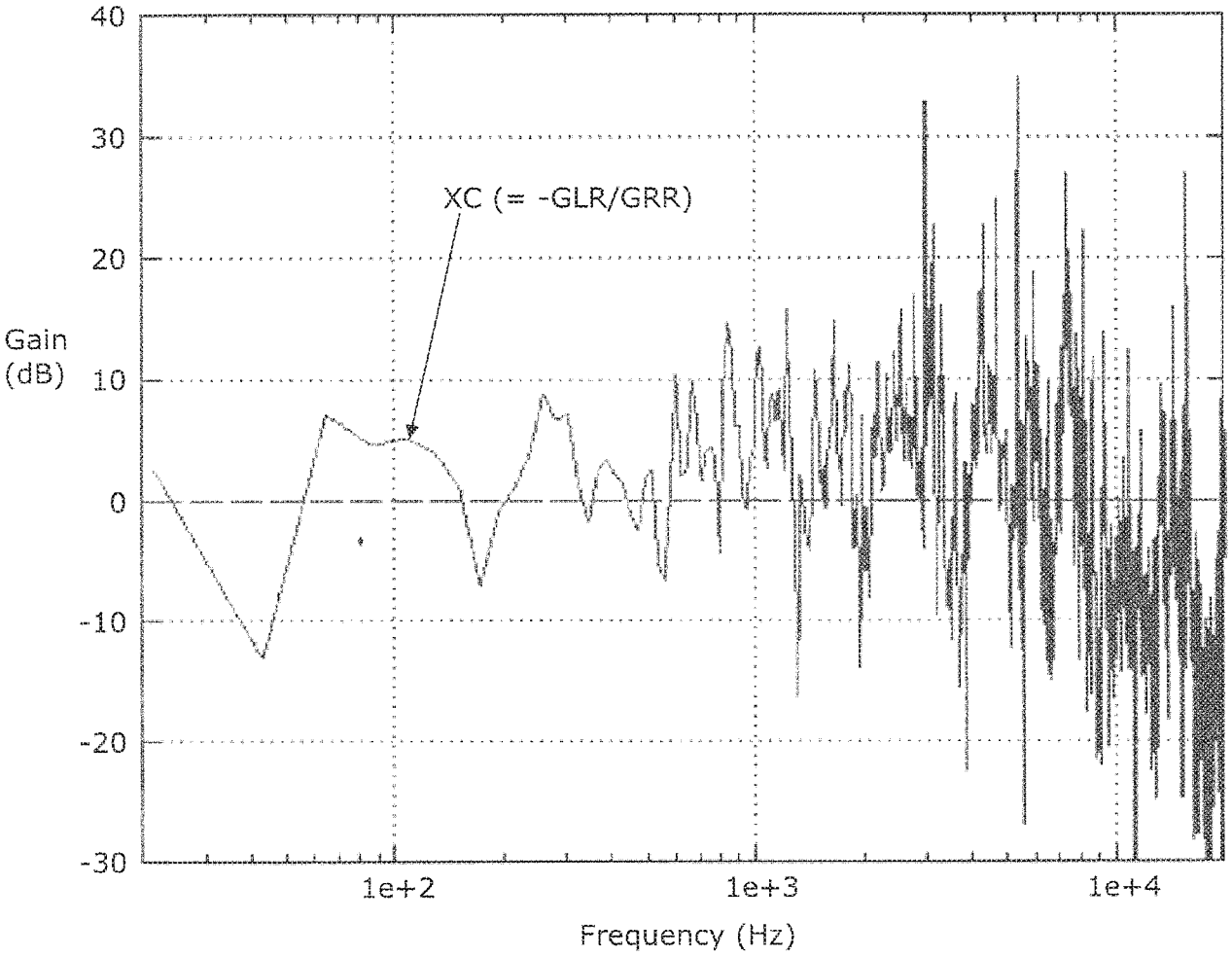
FIG. 11C is a diagram illustrating an example of the frequency characteristics of a designed crosstalk canceller.

FIG. 11A through FIG. 11C illustrate the examples of actual measurements of transfer functions inside a vehicle. FIG. 11A is a diagram illustrating the examples of the impulse response measurement when speakers are placed asymmetrically (inside a vehicle in this case) as illustrated in FIG. 10. The upper graph in FIG. 11A shows an impulse response from right speaker 1012 to right ear 1002 whereas the lower graph in FIG. 11A shows an impulse response from left speaker 1011 to right ear 1002. Focusing on the difference in amplitudes between the impulse response between right speaker 1012 and right ear 1002 and the impulse response between left speaker 1011 and right ear 1002, it is observed that the amplitude difference between the upper graph and the lower graph in FIG. 9A is large whereas the amplitude in the upper graph is almost identical to that in the lower graph in FIG. 11A. FIG. 11B is a diagram illustrating the frequency characteristics of the impulse responses shown in FIG. 11A. In other words, FIG. 11B shows the result of transforming, into frequency domain, each of the impulse response curves shown in the upper and lower graphs in FIG. 11A. The solid line presents transfer function GRR representing the frequency characteristics of the impulse response from right speaker 1012 to right ear 1002 while the dotted line presents transfer function GLR representing the frequency characteristics of the impulse response from left speaker 1011 to right ear 1002. FIG. 9B shows that |GRR|>|GLR| is satisfied at all the frequencies whereas FIG. 11B shows that |GRR|<|GLR| is satisfied depending on the frequency. Transfer function XC of crosstalk canceller 1030 is calculated based on these measurement results. The solid line in FIG. 11C presents an example of the frequency characteristics of transfer function XC of crosstalk canceller 1030. The gain of transfer function XC of crosstalk canceller 1030 exceeds 0 dB at many of the frequencies, and in such a case, a sound outputted for crosstalk cancellation from right speaker 1012 is greater than a sound outputted from left speaker 1011.

Thus, in the case where the speakers are placed asymmetrically, the inappropriate phenomenon such that a listener hears a sound greater than a sound originally desired to be heard by the listener can happen. In the case where two speakers are placed in a distorted position relative to listener 1000, e.g., inside a vehicle as illustrated in FIG. 10, the amplitude of a control sound that is output from speaker 1012 can be greater than the amplitude of a sound originally desired to be heard by listener 1000. As a result, a function to cancel crosstalk cannot respond to change in acoustic characteristics due to change in the listening position of listener 1000 (e.g., change in the forward-backward and right-left movement or direction of the head), and appropriate crosstalk cancellation cannot be performed.

In order to solve this problem, the signal processor according to one aspect of the present disclosure is a signal processor that performs crosstalk cancellation on an audio signal that is input, in a distorted acoustic space where two speakers are placed, the two speakers including an X-side speaker placed on an X-side of a listener and a Y-side speaker placed on a Y-side of the listener, where X denotes one of left and right, and Y denotes the other of left and right. The signal processor includes a controller that controls sounds to be output from the two speakers so that a sound of the audio signal is substantially cancelled at a Y-side ear that is a listener's ear on the Y-side. The controller causes the Y-side speaker to output a sound of the audio signal and causes the X-side speaker to output a sound of a signal obtained by processing the audio signal using transfer function GCY, where a transfer function between the Y-side speaker and the Y-side ear is defined as GYY, a transfer function between the X-side speaker and the Y-side ear is defined as GXY, and a transfer function obtained by dividing the transfer function GYY by the transfer function GXY is defined as GCY.

Thus, a sound of the signal obtained by processing the audio signal using the transfer function GCY is output (i.e., a control sound is output) not from the Y-side speaker but from the X-side speaker. It is therefore possible to cancel crosstalk without increasing the gain of a crosstalk canceller even in a distorted acoustic space. Accordingly, it is possible, even in a distorted acoustic space, to reduce the inappropriate phenomenon such that a listener hears a sound that is greater than a sound that is originally desired to be heard by the listener. In other words, appropriate crosstalk cancellation can be realized.

Note that these comprehensive or concrete embodiments may be realized by a system, a method, an integrated circuit, a computer program, or a recording medium such as a computer-readable CD-ROM, or may be realized by any combination thereof.

The following describes in detail the embodiments of the signal processor according to one aspect of the present disclosure with reference to the drawings.

Note that the embodiment described below illustrates a comprehensive or concrete example of the present invention. The values, shapes, materials, components, the arrangement and connection of the components, steps, an order of steps, etc. shown in the following embodiment are mere examples, and therefore are not intended to limit the inventive concept of the present invention. Among the components described in the following embodiment, the components not recited in any one of independent claims presenting the primary concept of the present invention are described as arbitrary components.

Embodiment 1

Figure 1:
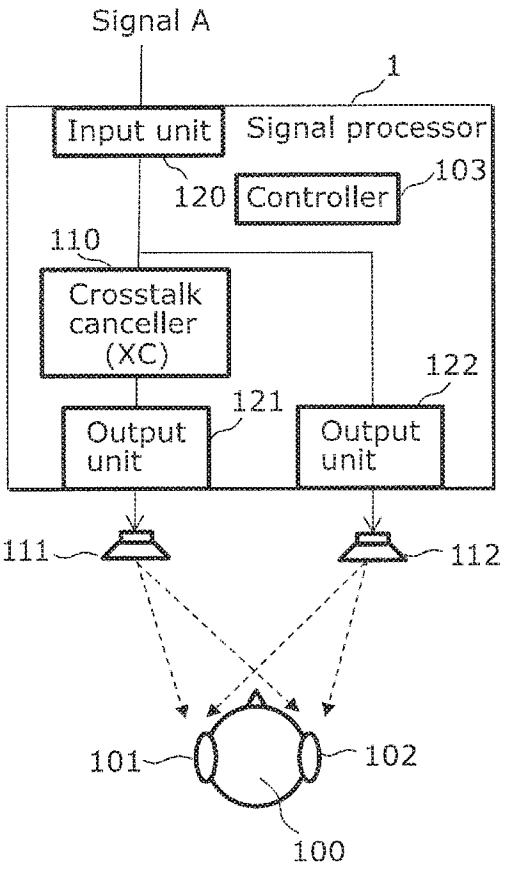
FIG. 1 is a diagram illustrating an example of the configuration of a signal processor according to Embodiment 1, speakers, and a listener.

FIG. 1 is a diagram illustrating an example of the configuration of signal processor 1 according to this embodiment, speakers, and listener 100. In the diagram, signal processor 1 includes controller 103, crosstalk canceller 110, input unit 120, and output units 121 and 122. Signal processor 1 processes an audio signal that is input from input unit 120 by, for example, using crosstalk canceller 110 under the control by controller 103, outputs, from output unit 121, an output audio signal for outputting a sound from left speaker 111 located outside signal processor 1, and outputs, from output unit 122, an output audio signal for outputting a sound from right speaker 112 located outside signal processor 1.

Here, controller 103 inputs audio signal A desired to be reproduced and controls crosstalk canceller 110 and output units 121 and 122 so as to realize the state where a sound reaches only left ear 101 of listener 100 but does not reach right ear 102. As illustrated in FIG. 1, crosstalk canceller 110 (the transfer function thereof is defined as XC) is placed on a side opposite to a side where a crosstalk canceller is located as in FIG. 8 or FIG. 10. Namely, crosstalk canceller 110 is placed on a pathway to output unit 121 intended for left speaker 111 and not on a pathway to output unit 122 intended for right speaker 112. Stated differently, a sound desired to be heard by listener 100 is played back not from left speaker 111 but from right speaker 112, and crosstalk canceller 110 is placed on the side of left speaker 111.

In order to realize 0 at right ear 102 of listener 100, in this case, when a transfer function between right speaker 112 and right ear 102 is defined as GRR, a transfer function between left speaker 111 and right ear 102 is defined as GLR, and a transfer function of crosstalk canceller 110 is defined as XC, Formula 3 needs to be satisfied to gain 0 (i.e., to cancel a sound) at right ear 102.

$$GRR+GLR*XC=0 \quad \text{(Formula 3)}$$

Transfer function XC of crosstalk canceller 110 can be derived by Formula 4 based on Formula 3.

$$XC=-GRR/GLR \quad \text{(Formula 4)}$$

It is possible, by Formula 4, to decrease gain |XC| of transfer function XC of crosstalk canceller 110 to be smaller than 1, even in the case of |GRR|<|GLR|. This can prevent the aforementioned problem of increase in the number of taps caused when realizing crosstalk cancellation in a distorted acoustic space in time domain. Thus, it is possible to reduce the significant degradation in control performance due to change in acoustic characteristics, that is, the inappropriate phenomenon such that listener 100 hears a sound greater than a sound that is originally desired to be heard by listener 100.

Figure 2A:
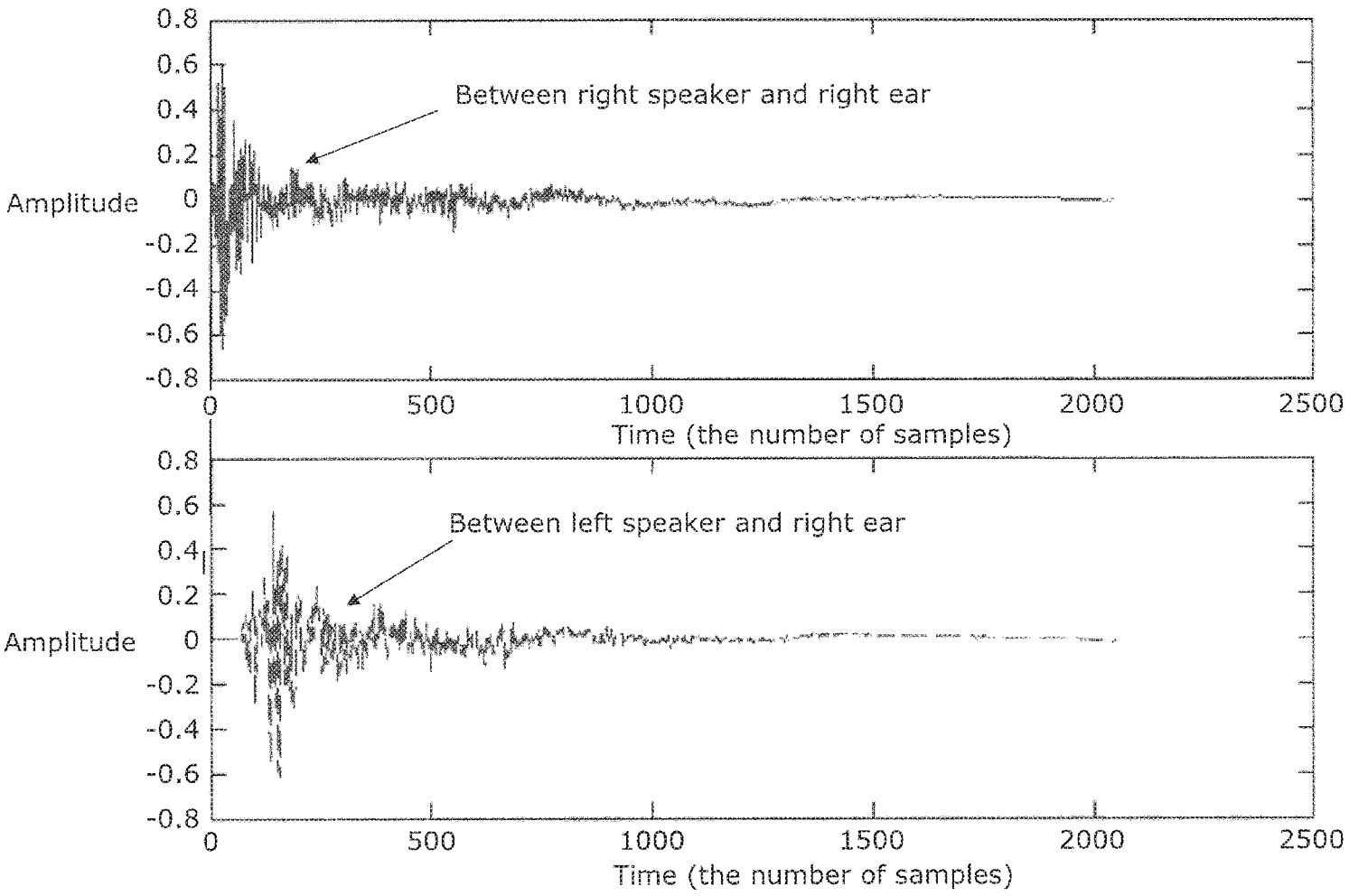
FIG. 2A is a diagram illustrating examples of the impulse response measurement of acoustic characteristics when speakers are placed asymmetrically.
Figure 2B:
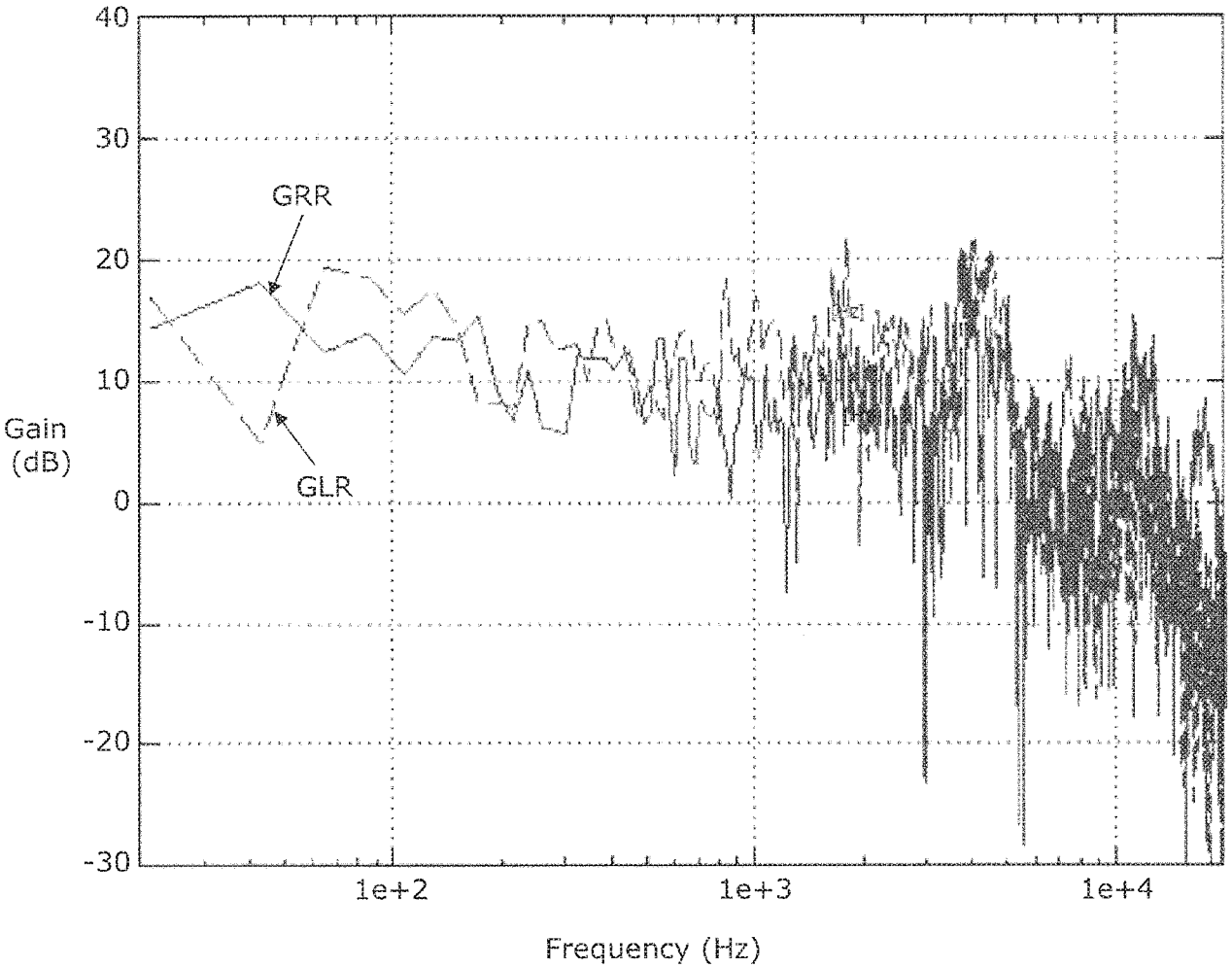
FIG. 2B is a diagram illustrating the frequency characteristics of the impulse response measurement examples illustrated in FIG. 2A.
Figure 2C:
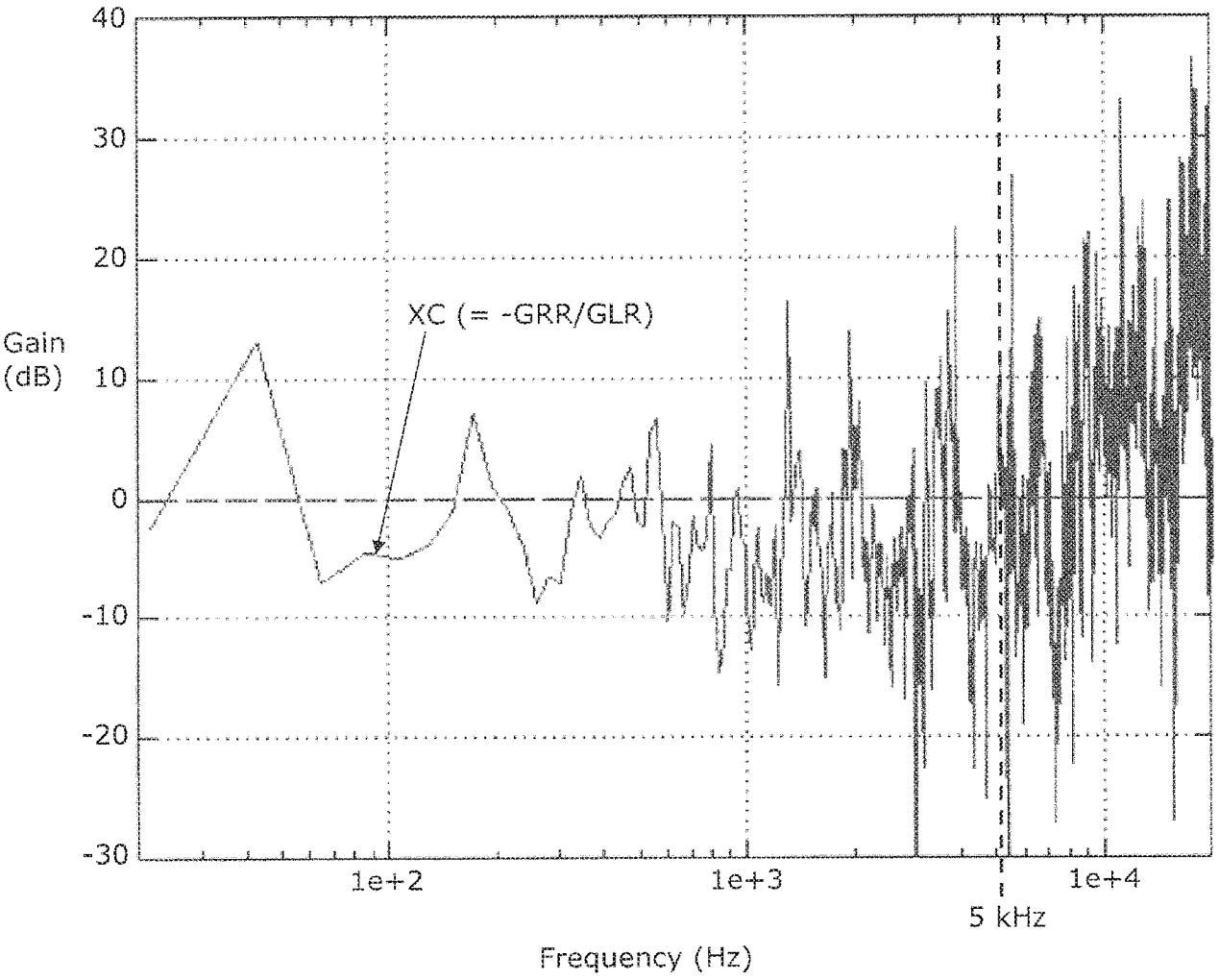
FIG. 2C is a diagram illustrating an example of the frequency characteristics of a designed crosstalk canceller.

FIG. 2A through FIG. 2C illustrate the results of designing crosstalk canceller 110 in FIG. 1 using the measurement results shown in FIG. 11A and FIG. 11B. FIG. 2A is a diagram illustrating the examples of the impulse response measurement of acoustic characteristics when speakers are placed asymmetrically. The upper graph in FIG. 2A illustrates an impulse response from right speaker 112 to right ear 102 while the lower graph in FIG. 2A illustrates an impulse response from left speaker 111 to right ear 102. FIG. 2B is a diagram illustrating the frequency characteristics of the impulse response measurements shown in FIG. 2A. In other words, FIG. 2B shows the result of transforming, into frequency domain, the impulse response curves shown in the upper and lower graphs in FIG. 2A. The solid line presents transfer function GRR representing the frequency characteristics of the impulse response from right speaker 112 to right ear 102 while the dotted line presents transfer function GLR representing the frequency characteristics of the impulse response from left speaker 111 to right ear 102. FIG. 2A and FIG. 2B shall be identical to FIG. 11A and FIG. 11B, respectively, for comparison.

Calculation, using these graphs in FIG. 2A and FIG. 2B and with the configuration illustrated in FIG. 1, of the frequency characteristics of transfer function XC of crosstalk canceller 110 brings the result as shown in FIG. 2C. Stated differently, FIG. 2C is a diagram illustrating an example of the frequency characteristics of designed crosstalk canceller 110. The diagram shows that, when crosstalk canceller 110 has been designed for the configuration illustrated in FIG. 1, there are more of the frequencies at each of which gain |XC| of transfer function XC of crosstalk canceller 110 takes a value smaller than 0 dB, as compared with FIG. 11C which is a comparison example.

This is because at many of the frequencies, gain |GLR| of the frequency characteristics between left speaker 111 and right ear 102 is greater than gain |GRR| of the frequency characteristics between right speaker 112 and right ear 102 in the bands smaller than or equal to approximately 5 kHz. In these bands, it is possible to reduce the volume of a control sound for crosstalk cancellation than a sound desired to be played back. Thus, it is possible to solve the problem as described above, that is, to prevent the inappropriate phenomenon such that a listener hears a sound greater than a sound that is originally desired to be heard by the listener, when the speakers are placed asymmetrically.

Note that the case of realizing the state in which a sound reaches only left ear 101 and does not reach right ear 102 is explained here, but the same also applies to the case of realizing the state in which a sound reaches only right ear 102 and does not reach left ear 101.

As has been described so far, signal processor 1 according to this embodiment is a signal processor that performs crosstalk cancellation on an audio signal that is input, in a distorted acoustic space where two speakers are placed, the two speakers including an X-side speaker placed on an X-side of a listener and a Y-side speaker placed on a Y-side of the listener, where X denotes one of left and right, and Y denotes the other of left and right. Signal processor 1 includes controller 103 that controls sounds to be output from the two speakers so that a sound of the audio signal is substantially cancelled at a Y-side ear that is a listener's ear on the Y-side. Controller 103 causes the Y-side speaker to output a sound of the audio signal and causes the X-side speaker to output a sound of a signal obtained by processing the audio signal using transfer function GCY, where a transfer function between the Y-side speaker and the Y-side ear is defined as GYY, a transfer function between the X-side speaker and the Y-side ear is defined as GXY, and a transfer function obtained by dividing the transfer function GYY by the transfer function GXY is defined as GCY.

For example, when X denotes left and Y denotes right, an X-side speaker corresponds to left speaker 111 and a Y-side speaker corresponds to right speaker 112. Moreover, transfer functions GYY and GXY correspond to transfer functions GRR and GLR, respectively, which are illustrated in FIG. 2B. Transfer function GCY corresponds to transfer function XC illustrated in FIG. 2C.

Moreover, when X denotes right and Y denotes left, a crosstalk canceller is provided between input unit 120 and output unit 122 on the right, instead of crosstalk canceller 110 in the configuration illustrated in FIG. 1. Then, an X-side speaker corresponds to right speaker 112 and a Y-side speaker corresponds to left speaker 111. Moreover, transfer functions GYY and GXY correspond to transfer functions GLL and GRL, respectively. Transfer function GCY corresponds to (−GLL/GRL).

According to this configuration, a sound of a signal obtained by processing the audio signal using GCY is output (i.e., a control sound for cancellation is output) not from the Y-side speaker but from the X-side speaker. It is therefore possible, even in a distorted acoustic space, to cancel crosstalk without increasing the gain of a crosstalk canceller. Accordingly, it is possible to prevent, even in a distorted acoustic space, the inappropriate phenomenon such that a listener hears a sound greater than a sound that is originally desired to be heard by the listener. Namely, appropriate crosstalk cancellation can be realized.

Here, controller 103 may cause the X-side speaker to output a sound of a signal obtained by multiplying the audio signal by −GCY.

Moreover, signal processor 1 according to this embodiment is a signal processor that processes an audio signal that is input, and outputs the audio signal processed. Signal processor 1 includes: input unit 120 configured to input a first audio signal; controller 103 that processes the first audio signal to output a second audio signal and a third audio signal; a first output unit configured to output the second audio signal to outside; and a second output unit configured to output the third audio signal to outside. Controller 103 outputs the first audio signal as the second audio signal, and outputs, as the third audio signal, a signal obtained by multiplying the first audio signal by −GCY, where a transfer function between a first speaker and one ear of a listener is defined as GYY, the first speaker outputting the second audio signal as a sound, a transfer function between a second speaker and the one ear of the listener is defined as GXY, the second speaker outputting the third audio signal as a sound, and a transfer function obtained by dividing the transfer function GYY by the transfer function GXY is defined as GCY.

For example, the first output unit and the second output unit correspond to output unit 121 on the left and output unit 122 on the right, respectively, in the configuration example illustrated in FIG. 1, and the aforementioned one ear corresponds to right ear 102. Moreover, transfer functions GYY and GXY correspond to transfer functions GRR and GLR, respectively, which are illustrated in FIG. 2B. Transfer function GCY corresponds to transfer function XC illustrated in FIG. 2C.

Moreover, the first output unit and the second output unit correspond to output unit 122 on the right and output unit 121 on the left, respectively, and the aforementioned one ear corresponds to left ear 101, for example. In this case, a crosstalk canceller is provided between input unit 120 and output unit 122 on the right, instead of crosstalk canceller 110 in FIG. 1. Then, transfer functions GYY and GXY correspond to transfer functions GLL and GRL, respectively. Transfer function GCY corresponds to (−GLL/GRL).

Even with this configuration, it is possible, even in a distorted acoustic space, to prevent the inappropriate phenomenon such that a listener hears a sound greater than a sound that is originally desired to be heard by the listener, as in the case described above. Namely, appropriate crosstalk cancellation can be realized.

Embodiment 2

In the actually measured acoustic characteristics, |GRR|<|GLR| is not satisfied at all the frequencies and the frequencies at which |GRR|>|GLR| is satisfied may also be included in some cases, as illustrated in FIG. 2C in Embodiment 1.

In such a case, it can be observed that, with the configuration illustrated in FIG. 1, gain |XC| of crosstalk canceller 110 is greater than 1 at the frequency where |GRR|>|GLR| is satisfied, as derived by Formula 5.

$$XC=-GRR/GLR \quad \text{(Formula 5)}$$

FIG. 2C shows that in many of the frequencies each having a band greater than or equal to 5 kHz, |XC|>1 is satisfied, but this is because |GRR|>|GLR| is satisfied at these frequencies.

Figure 3A:
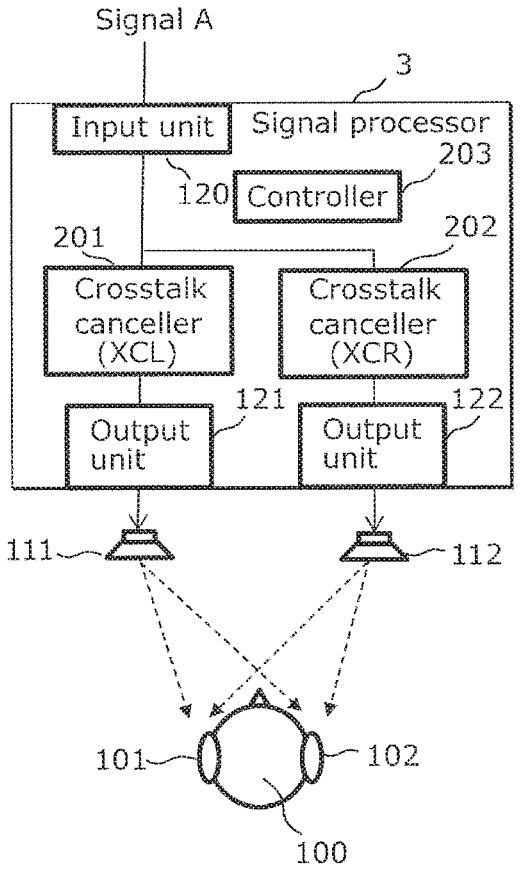
FIG. 3A is a diagram illustrating an example of the configuration of a signal processor according to Embodiment 2, speakers, and a listener.

In view of the above, with the configuration as illustrated in FIG. 3A, more appropriate control is realized. FIG. 3A is a diagram illustrating an example of the configuration of signal processor 3 according to Embodiment 2, speakers 111 and 112, and listener 100. In FIG. 3A, input signals for speakers 111 and 112 are processed by crosstalk cancellers 201 and 202, respectively. Transfer functions of crosstalk cancellers 201 and 202 are defined as XCL and XCR, respectively. These transfer functions XCL and XCR are designed as follows.

$$XCL(n)=1 \quad \text{(Formula 6A)}$$

$$XCR(n)=R(n)=-GLR(n)/GRR(n) \quad \text{(Formula 6B)}$$

Note, however, that the above Formulas 6A and 6B shall be used when |GRR(n)|≥|GLR(n)|.

$$XCL(n)=L(n)=-GRR(n)/GLR(n) \quad \text{(Formula 7A)}$$

$$XCR(n)=1 \quad \text{(Formula 7B)}$$

Note, however, that the above Formulas 7A and 7B shall be used when |GRR(n)|<|GLR(n)|.

Note, however, that n denotes a frequency sample point obtained when transformation into frequency domain is performed, and presents, for example, any one of N (N being 0 to N−1) number of sample points. Alternatively, n may be an index indicating each frequency band obtained by dividing an audio signal into N segments. XCL(n) etc. denotes a sample value at sample point n or a sample value (transfer function) of a frequency band indicated by n.

Figure 3B:
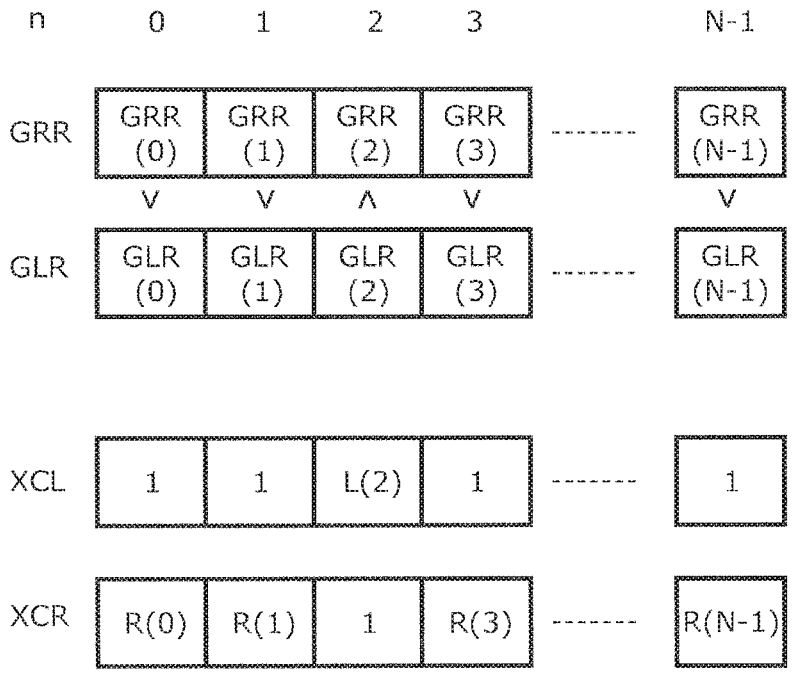
FIG. 3B is an explanatory drawing illustrating examples of the detailed designs of crosstalk cancellers according to Embodiment 2.

In the above formulas, |GLR(n)| and |GRR(n)| are compared for each frequency, and based on the result thereof, the transfer functions of crosstalk cancellers 201 and 202 are designed for each frequency. FIG. 3B illustrates the schematic view thereof. FIG. 3B is an explanatory drawing illustrating the examples of the detailed designs of the crosstalk cancellers according to Embodiment 2.

Both of transfer function GRR representing the frequency characteristics between right speaker 112 and right ear 102 and transfer function GLR representing the frequency characteristics between left speaker 111 and right ear 102 are Fourier transformed using N number of samples, and frequency sample point n has a value ranging from 0 to N−1. Gain |GRR(n)| and gain |GLR(n)| of the transfer function at frequency sample point n are compared, and transfer functions XCL(n) and XCR(n) of crosstalk cancellers 201 and 202 are determined based on the result of the comparison. For example, since |GRR(0)|>|GLR(0)|, XCL(0) is determined to be 1 and XCR(0) is determined to be R(0)=−GLR(0)/GRR(0). This is performed for all the frequency samples from 0 to N−1, and the frequency characteristics of transfer functions XCL and XCR are determined.

With this, it is possible to prevent the gains of crosstalk cancellers 201 and 202 from being greater than 1 and thereby realize more appropriate control.

Figure 4A:
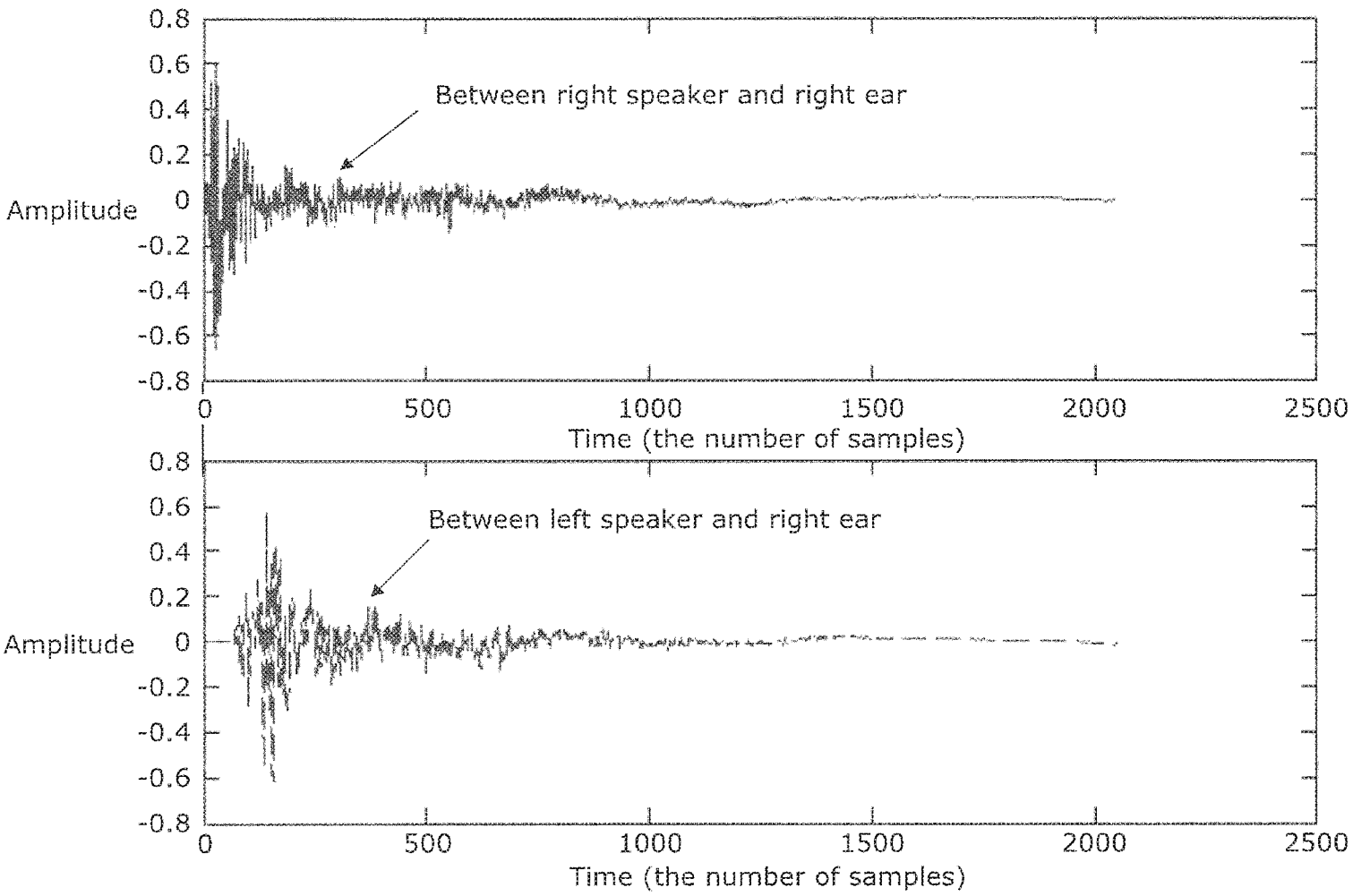
FIG. 4A is a diagram illustrating examples of impulse response measurement when speakers are placed asymmetrically according to Embodiment 2.
Figure 4B:
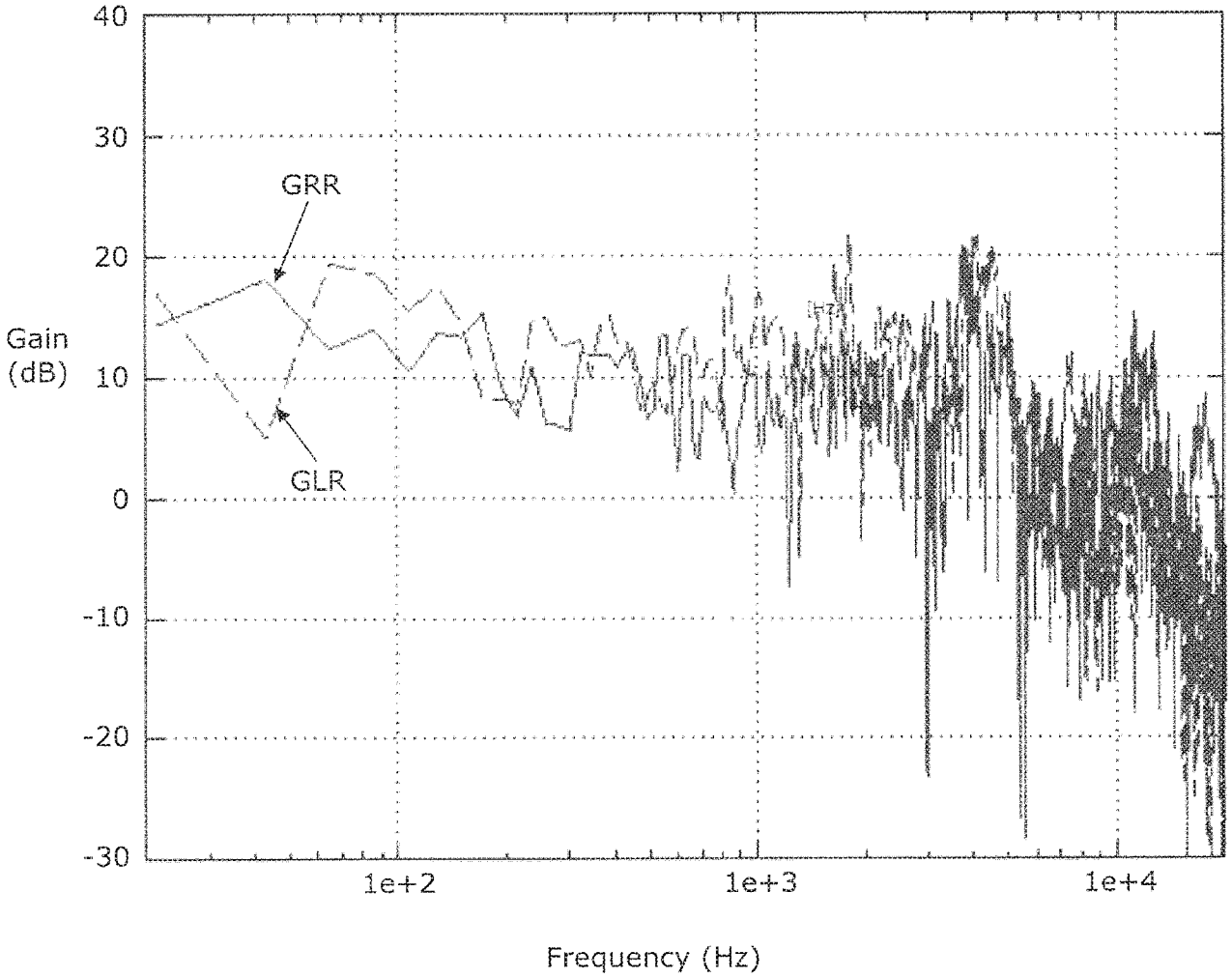
FIG. 4B is a diagram illustrating the frequency characteristics of the impulse response measurement examples illustrated in FIG. 4A according to Embodiment 2.
Figure 4C:
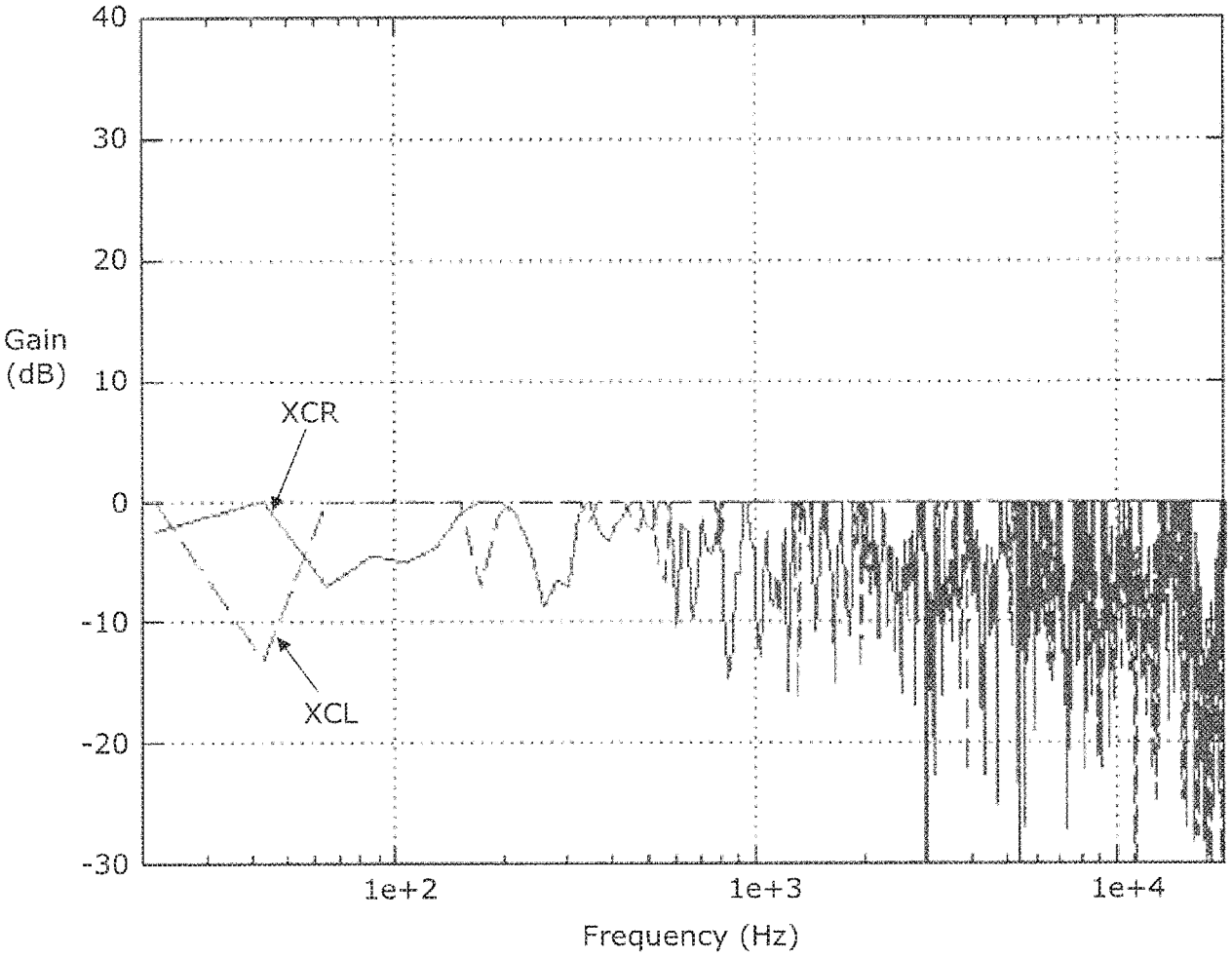
FIG. 4C is a diagram illustrating examples of the frequency characteristics of the crosstalk cancellers designed according to Embodiment 2.

FIG. 4C shows the result of designing crosstalk cancellers 201 and 202 by implementing the algorithms described above, based on FIG. 4A and FIG. 4B showing the measurement results used in the examples in FIG. 11A and FIG. 11B. FIG. 4A and FIG. 4B are diagrams illustrating the examples of impulse response measurement and frequency characteristics when the speakers are placed asymmetrically, as illustrated in FIG. 2A and FIG. 2B, respectively. FIG. 4C is a diagram illustrating the examples of the frequency characteristics of the crosstalk cancellers designed according to Embodiment 2.

As can be seen from the graph in FIG. 4C, it is possible to cause the gains of transfer functions XCL and XCR to be smaller than or equal to 0 dB at all the frequencies.

Figure 5:
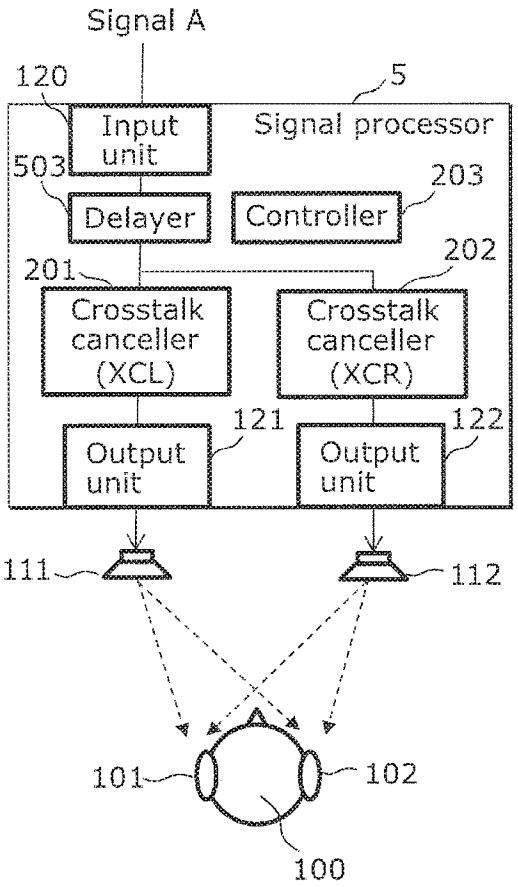
FIG. 5 is a diagram illustrating an example of the configuration of a signal processor provided with a delayer according to Embodiment 2, speakers, and a listener.
Figure 6A:
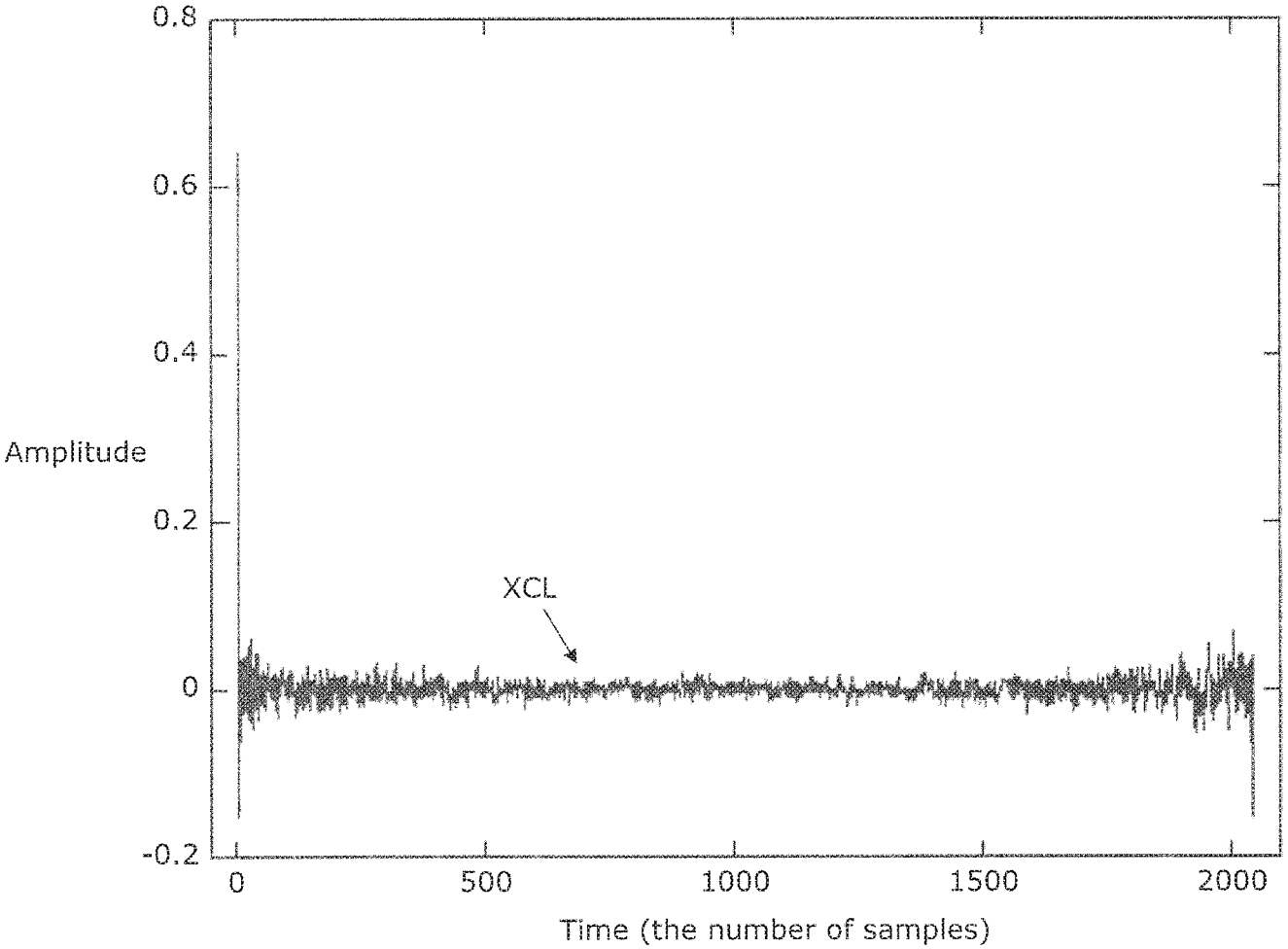
FIG. 6A is a diagram illustrating an example of the impulse response of the crosstalk canceller designed according to Embodiment 2.
Figure 6B:
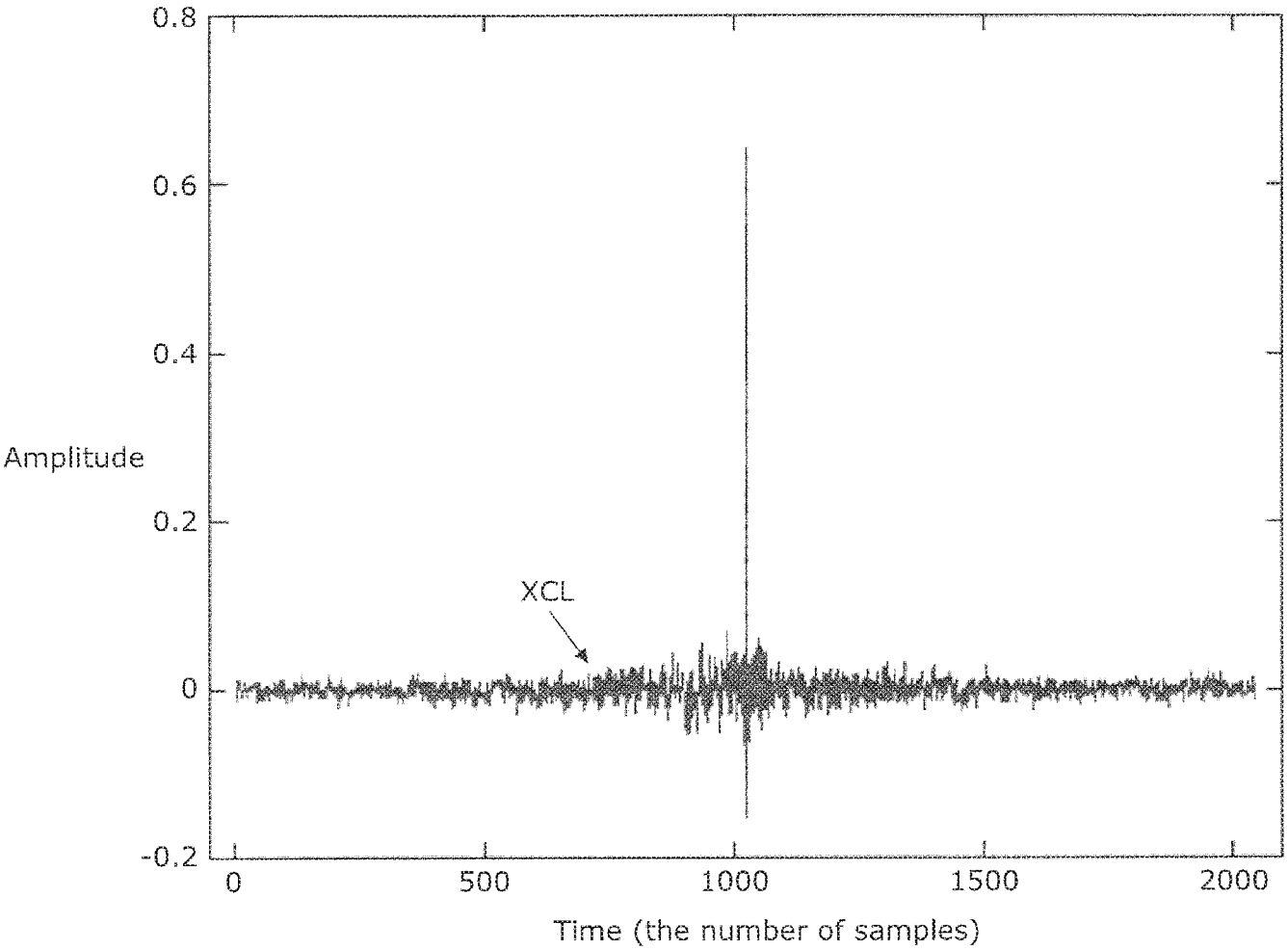
FIG. 6B is a diagram illustrating an example of the impulse response of the crosstalk canceller designed by taking time advance into account according to Embodiment 2.

Here, a word of cautions to be taken when transforming the filter (crosstalk canceller) designed as described above into time domain will be explained. In the comparison between the two impulse responses shown in FIG. 4A, for example, a peak of GRR rises up earlier than that of GLR and a delay time between the peaks may be short. In this case, when transfer function XCL of crosstalk canceller 201 in a certain frequency sample is calculated using the formula expressed by XCL(n)=−GRR(n)/GLR(n), the filter itself may have one or more time-advance components. Advancing time does not satisfy a causality between sound output from one speaker and sound output from the other speaker, and therefore, the causality cannot be satisfied if this remains to be solved. However, this time-advance component needs to be the one that is relative in the relationship between the output of left speaker 111 and the output of right speaker 112. It is therefore possible to satisfy the causality by delaying time on the whole. More specifically, delayer 503 is provided as illustrated in FIG. 5. Delayer 503 has a delay time greater than the maximum value of each of the time-advance components of crosstalk cancellers 201 and 202. When, for example, the time-advance components of crosstalk cancellers 201 and 202 are defined as zNL and zNR and L>R (note, however, that L and R are integers greater than or equal to 0), delayer 503 delays an input signal itself by L number of samples at least. With this, the time-advance component of the output from left speaker 111 at the time of input or output becomes 0. This enables processing that satisfies the causality while keeping a relative delay time difference between the output from left speaker 111 and the output from right speaker 112. This adjustment in delay time can be realized even in frequency domain. FIG. 6A is a diagram illustrating the examples of the impulse response obtained as a result of inverse Fourier transforming, into time domain, crosstalk canceller XCL designed for the configuration illustrated in FIG. 4C. Looking at these coefficients, a peak appears near time sample 0, but a value with a large amplitude is also observed at the end of the time samples (near sample 2000). Time-advance component appears at last at the end of time samples, which is one of the natures of Fourier transformation, this therefore means that designed crosstalk canceller XCL has one or more time-advance components. In view of the above, a delay is caused in frequency domain in order to eliminate this time-advance component. More specifically, when the number of samples caused to be delayed is defined as d, d number of samples are taken out from the end of coefficients towards time sample 0 and are displaced to the position before time sample 0. This has caused delay by d number of samples on the whole. FIG. 6B illustrates the result of delaying time when d=1024. FIG. 6B is a diagram illustrating the examples of the impulse response of the crosstalk canceller designed by taking time advance into account according to Embodiment 2. By performing this processing in the same manner also for crosstalk canceller XCR on the side of the right speaker, it is possible to satisfy the causality as a filter without changing a relative time delay between crosstalk canceller XCL on the left speaker and crosstalk canceller XCR on the right speaker. A Hanning window or the like may be multiplied to the coefficients thus generated so that the coefficients converge near time sample 0 as well as near the end of time samples and then are used.

Note that this embodiment describes delay time using the number of samples, with the number being an integer, but the same is applicable to the case where the number is not an integer.

As has been described above, controller 203 in signal processor 5 according to this embodiment transforms an audio signal into frequency band signals F(n), where n denotes an index indicating each frequency band. Here, for each frequency band indicated by n: a transfer function between the Y-side speaker and the Y-side ear is defined as GYY(n); a transfer function between the X-side speaker and the Y-side ear is defined as GXY(n); a transfer function between the Y-side speaker and an X-side ear that is a listener's ear on the X-side is defined as GYX(n); a transfer function between the X-side speaker and the X-side ear is defined as GXX(n); a transfer function obtained by dividing the transfer function GYY(n) by the transfer function GXY(n) is defined as GCY(n); a transfer function obtained by dividing the transfer function GXY(n) by the transfer function GYY(n) is defined as GCX(n).

Controller 203 compares, for each frequency band indicated by n, a gain of transfer function GYY(n) with a gain of transfer function GXY(n), causes the Y-side speaker to output a sound of one of the frequency band signals F(n) and causes the X-side speaker to output a sound of a signal obtained by processing the one of the frequency band signals F(n) using transfer function GCY(n), when the gain of the transfer function GXY(n) is greater than the gain of the transfer function GYY(n), and causes the X-side speaker to output the sound of the one of the frequency band signals F(n) and causes the Y-side speaker to output a sound of a signal obtained by processing the one of the frequency band signals F(n) using transfer function GCX(n), when the gain of the transfer function GYY(n) is greater than the gain of the transfer function GXY(n).

This can prevent the gain of a control sound for crosstalk cancellation from being greater than 1 for each frequency band indicated by n, and thereby realize more appropriate control. In other words, it is possible, even in a distorted acoustic space, to more assuredly prevent the inappropriate phenomenon such that a listener hears a sound greater than a sound that is originally desired to be heard by the listener, and thus realize more appropriate crosstalk cancellation. Here, signal processor 5 further includes delayer 503 that delays an audio signal that is input, and a delay time caused by delayer 503 is set to satisfy a causality between sound output from the X-side speaker and sound output from the Y-side speaker.

Embodiment 3

The signal processor that has been described so far controls sound output by processing an input signal using a crosstalk canceller designed according to each of the aforementioned embodiments, and playing back a sound of the processed signal from the speaker. It is also effective, however, to use a signal processor in such a way that a signal processed by a crosstalk canceller is once recorded on a recording device such as a memory or a hard disk drive and the processed signal is reproduced when necessary.

Figure 7:
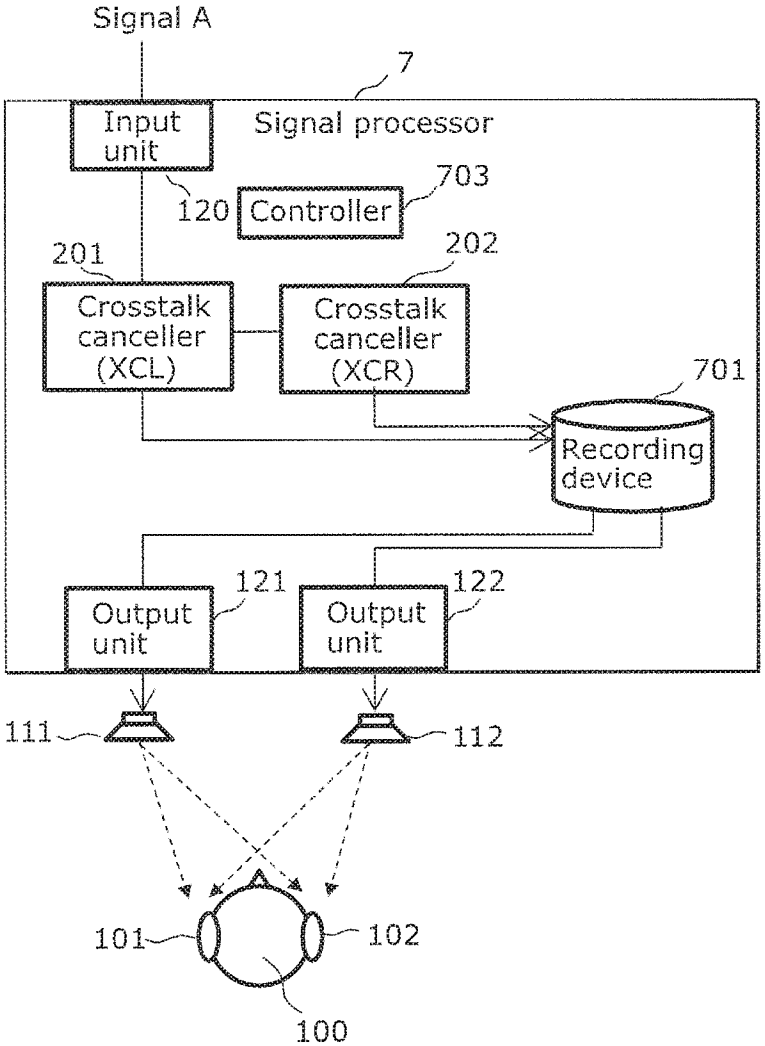
FIG. 7 is a diagram illustrating an example of the configuration of a signal processor according to Embodiment 3, speakers, and a listener.

FIG. 7 illustrates a block diagram of the signal processor for such use. FIG. 7 is a diagram illustrating an example of the configuration of signal processor 7 according to Embodiment 3, speakers 111 and 112, and listener 100. Audio signal A is signal processed by crosstalk cancellers 201 (XCL) and 202 (XCR) designed using the method as described above, and is recorded as an output signal on recording device 701. The output signal recorded on recording device 701 is read out from recording device 701 at a predetermined timing and is reproduced from left speaker 111 and right speaker 112. The reproduction timing can be set using, for example, an event through user's operation or a timestamp, or the like, as a trigger.

Here, the output signal that has been signal processed by crosstalk cancellers 201 (XCL) and 202 (XCR) may be generated either in real-time or off-line processing. Since the signal processing performed by crosstalk cancellers 201 and 202 is fixed, in the case of repeatedly processing and reproducing the same signal, it is effective to record, on recording device 701, an output signal that has once been generated and reproduce the recorded output signal when reproducing it the next time and thereafter, in order to reduce the load imposed by the amount of computation required to be processed by crosstalk cancellers 201 and 202. Moreover, it is also possible to generate an output signal to be recorded on recording device 701 using a device different from a reproducer, such as a PC. In such a case, the reproducer does not need a signal processor such as a DSP for realizing filter processing using crosstalk cancellers 201 (XCL) and 202 (XCR), and this enables simplification of the reproducer. Furthermore, since such form of usage imposes no limitation on the computation time required for this filter processing, a filter designed to have many taps can be used.

As has been described above, signal processor 7 according to this embodiment includes a recording device that records an audio signal of a sound to be output from the X-side speaker and an audio signal of a sound to be output from the Y-side speaker.

This configuration enables signal processor 7 to perform not only real-time processing but also off-line processing. In off-line processing, no limitation is set for a computation time, a filter processing (crosstalk cancellation) designed to have many taps can be used.

Note that recording device 701 may be provided on a server connected to the Internet. A reproducer can attain desired effects by accessing the server via the Internet and reproducing a filter processed signal. The filter processed signal may be optimized for each reproducer depending on the type of vehicle, or may be optimized for reproducers resulting from grouping of plural types of reproducers. Furthermore, a signal obtained by performing filter processing on desired audio in accordance with a reproducer via user's instruction may be provided.

Embodiment 4

Crosstalk cancellation is a technique to render an audio signal that reaches one ear to be 0. Stated differently, it is therefore a technique to produce a state where a sound reaches only the other ear. In such a case, a listener feels that a sound is heard at that ear.

The situation in which a listener hears a sound only by one ear causes various psychological conditions. Such conditions are, for example, being annoyed by a mosquito flying near the ear, being excited to hear lover's whispering at the ear, feeling ghastly when the presence of a zombie is felt at the ear, being surprised at a bullet missing the ear by inches, etc.

The inventors of the present invention attempt to apply such auditory psychological phenomena for the enhancement of the pleasure gained by playing games and pleasant awakening.

The invention according to Embodiment 2 as described above had an intention to effectively render an audio signal that reaches one ear to be 0.

Embodiment 4 describes the technology configured with an intention to increase the sense of hearing a sound at an intended ear by selecting, when a selection is to be made between an option to render an audio signal that reaches one ear to be 0 and an option to render an audio signal that reaches the other ear to be 0 and the effects obtained are not so much different between the options, an option with which the audio signal that reaches the other ear becomes greater than the audio signal that reaches one ear.

In Embodiment 2 as described above, |GLR(n)| and |GRR(n)| are compared for each index n indicating a frequency band of frequency band signal F(n), and based on the result thereof, transfer functions XCL and XCR of crosstalk cancellers 201 and 202 are designed for each frequency.

Namely, transfer functions XCL and XCR are expressed as follows.

When $|GRR(n)| \geq |GLR(n)|$, $$XCL(n)=1 \quad \text{(Formula 6A)}$$

$$XCR(n)=R(n)=-GLR(n)/GRR(n) \quad \text{(Formula 6B)}$$

When $|GRR(n)| < |GLR(n)|$, $$XCL(n)=L(n)=-GRR(n)/GLR(n) \quad \text{(Formula 7A)}$$

$$XCR(n)=1 \quad \text{(Formula 7B)}$$

Here, when |GRR(n)| is substantially equal to |GLR(n)|, since the effect of rendering an audio signal, which reaches an ear targeted for crosstalk cancellation, to be 0 is the same whichever option may be taken, controller 203 controls so that the option with which an audio signal that reaches the other ear becomes greater than the audio signal that reaches one ear is selected.

The control method employed in such a case will be described with reference to FIG. 3A.

For each frequency band indicated by n, a transfer function representing the frequency characteristics between right speaker 112 and right ear 102 is defined as GRR(n), a transfer function representing the frequency characteristics between left speaker 111 and right ear 102 is defined as GLR(n), XCR(n)=−GLR(n)/GRR(n), XCL(n)=−GRR(n)/GLR(n), a transfer function representing the frequency characteristics between right speaker 112 and left ear 101 is defined as GRL(n), and a transfer function representing the frequency characteristics between left speaker 111 and left ear 101 is defined as GLL(n).

First, in the case where |GRR(n)| is substantially equal to |GLR(n)|, controller 203 compares |XCR(n)*GRL(n)+GLL(n)| and |XCL(n)*GLL(n)+GRL(n)|. When, for example, the ratio between |GRR(n)| and |GLR(n)| falls within the range of from −2 dB to +2 dB, |GRR(n)| is substantially equal to |GLR(n)|. Note that this range shall not be restricted to such.

Furthermore, when |GRR(n)| is greater than |GLR(n)|, controller 203 defines a transfer function of crosstalk canceller 201 as "1" and a transfer function of crosstalk canceller 202 as XCR(n).

Moreover, when |GLR(n)| is greater than |GRR(n)|, controller 203 defines a transfer function of crosstalk canceller 201 as XCL(n) and a transfer function of crosstalk canceller 202 as "1".

In the case where |GRR(n)| is not substantially equal to |GLR(n)|, controller 203 defines a transfer function of crosstalk canceller 201 as "1" and a transfer function of crosstalk canceller 202 as XCR(n) when |GRR(n)|>|GLR(n)|, and defines a transfer function of crosstalk canceller 201 as XCL(n) and a transfer function of crosstalk canceller 202 as "1" when |GRR(n)|<|GLR(n)|.

With such a control, controller 203 is capable of selecting with priority, for each frequency band signal F(n), a method which provides a large effect of rendering an audio signal that reaches one ear to be 0, and selecting, for a frequency band for which the effects are substantially the same between the options as described above, a method with which an audio signal that reaches the other ear becomes greater. It is therefore possible to render notably effective the effect that a listener hears a sound at the ear.

Next, a variation of Embodiment 4 will be described. This variation can be also applied to Embodiment 2.

Index n indicating a band of frequency band signal F(n), both in Embodiments 2 and 4, implicitly indicates each of the frequencies in FFT analysis, therefore, the bandwidths of frequency band signals F(n) are equal. In Embodiments 2 and 4, controller 203 designed (selected or determined) transfer functions XCL(n) and XCR(n) for each frequency band signal F(n). This variation describes an example in which plural extended bands, each binding plural frequency band signals F(n), are set, and transfer functions XCL(n) and XCR(n) are identically designed (selected or determined) for each extended band.

More specifically, controller 203 sets plural extended bands obtained by extending a bandwidth by binding plural frequency band signals F(n), that is, by binding adjacent frequency band signals F(n).

Furthermore, for the frequency band signals F(n) in the same extended band, controller 203 causes a design (selection or determination) for transfer function XCL(n) of crosstalk canceller 201 to be identical and also causes a design (selection or determination) for transfer function XCR(n) of crosstalk canceller 202 to be identical.

Figure 12A:
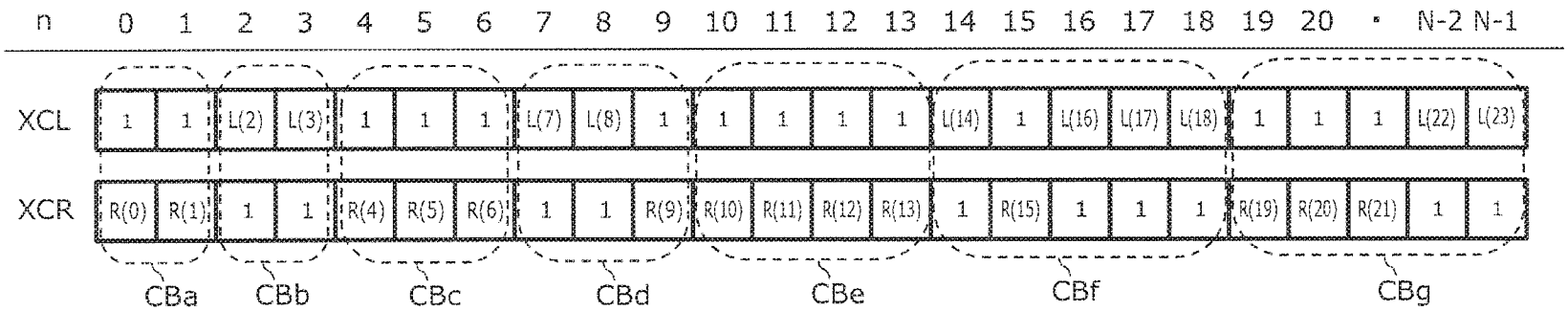
FIG. 12A is a diagram illustrating examples of transfer functions XCL(n) and XCR(n) that are designed for each frequency band indicated by n according to Embodiment 4.
Figure 12B:
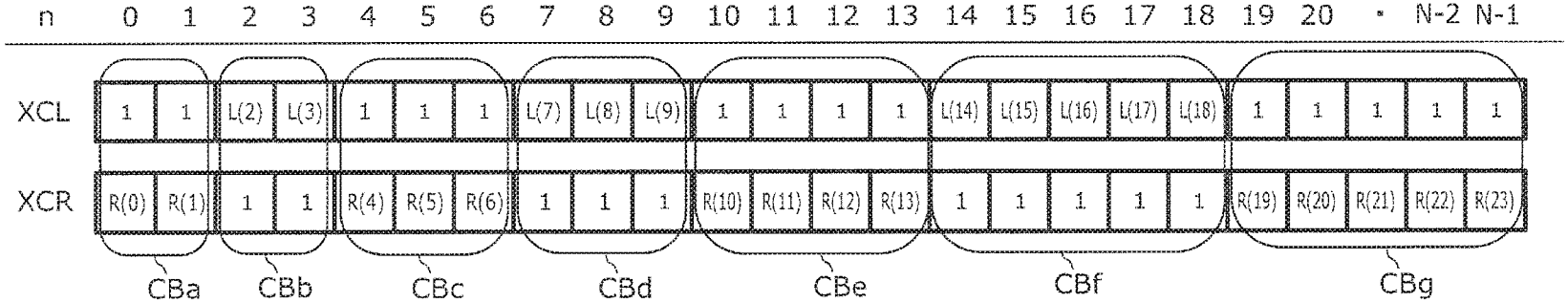
FIG. 12B is a diagram illustrating examples of transfer functions XCL(n) and XCR(n) that are designed for each extended band according to a variation of Embodiment 4.

FIG. 12A illustrates an example of applying extended bands and FIG. 12B illustrates an example of not applying extended bands.

FIG. 12A is a diagram illustrating the examples of transfer functions XCL(n) and XCR(n) designed for each frequency band indicated by n according to Embodiment 4. FIG. 12B is a diagram illustrating the examples of transfer functions XCL(n) and XCR(n) designed for each extended band according to the variation of Embodiment 4. Each of CBa through CBg in FIG. 12A and FIG. 12B illustrates an example of extended band.

In FIG. 12A, since transfer functions XCL(n) and XCR(n) are designed for each frequency band signal F(n), extended bands CBa through CBg have nothing to do with the design of transfer functions XCL(n) and XCR(n). Neither the design (selection or determination) of transfer function XCL(n) nor the design (selection or determination) of transfer function XCR(n) is always identical in each of extended bands CBa through CBg enclosed by a dotted line.

In contrast, the results obtained by designing (selecting or determining) transfer function XCL(n) or the results obtained by designing transfer function XCR(n) are identical in each of the extended bands CBa through CBg enclosed by a solid line in FIG. 12B. In the variation, controller 203, for example, may firstly design transfer functions XCL(n) and XCR(n) as illustrated in FIG. 12A and subsequently determine a design per extended band through the majority vote of the design results each being obtained per frequency band signal. By doing so, it is possible to avoid unnatural conditions in which a method of designing a filter changes for each of the frequency band signals F(n) that are adjacent to each other.

A method of binding frequency band signals F(n) for setting extended bands, in this case, may be determined according to a perceptive unit of human hearing, which is represented by a frequency axis and is called "critical band".

In this connection, critical bands are defined, in MPEG audio specifications ISO/IEC 13818-3, as psychoacoustic measurement in a frequency domain corresponding to the frequency selection properties of human ears.

FIG. 13 is a diagram illustrating an example of critical bands. The diagram is partly extracted from Table D.2a. of the aforementioned MPEG audio specifications, and illustrates critical band numbers (no) and frequencies each being the upper edge of one critical band. The diagram is effective for coding of layer I at the sampling rate of 16 kHz. Note that the definition of critical bands is not an absolute one and shall not be restricted to such.

As has been described above, when the gain of the transfer function GXY(n) is substantially equal to the gain of the transfer function GYY(n), controller 203 in the signal processor according to this embodiment: causes the X-side speaker to output a sound of one of the frequency band signals F(n) and causes the Y-side speaker to output a sound of a signal obtained by processing the one of the frequency band signals F(n) using transfer function GCX(n), if transfer function AX is greater than transfer function AY; and causes the Y-side speaker to output the sound of the one of the frequency band signals F(n) and causes the X-side speaker to output a sound of a signal obtained by processing the one of the frequency band signals F(n) using transfer function GCY(n), if the transfer function AY is greater than the transfer function AX, where for each frequency band indicated by n: a transfer function between the Y-side speaker and an X-side ear that is a listener's ear on the X-side is defined as GYX(n); a transfer function between the X-side speaker and the X-side ear is defined as GXX(n); a transfer function obtained by multiplying the transfer function GCX (n) by the transfer function GYX(n) and subsequently adding GXX to a result of the multiplication is defined as AX; and a transfer function obtained by multiplying the transfer function GCY(n) by the transfer function GXX(n) and subsequently adding GYX to a result of the multiplication is defined as AY.

Here, controller 203 may define extended bands each binding a plurality of the frequency band signals F(n), and causes a determination to be identical for the plurality of the frequency band signals F(n) in one of the extended bands, the determination being made upon whether to (i) cause the Y-side speaker to output the sound of the one of the frequency band signals F(n) and cause the X-side speaker to output a sound of a signal obtained by processing the one of the frequency band signals F(n) using the transfer function GCY(n) or (ii) cause the X-side speaker to output the sound of the one of the frequency band signals F(n) and cause the Y-side speaker to output a sound of a signal obtained by processing the one of the frequency band signals F(n) using the transfer function GCX(n).

Here, controller 203 may define the extended bands according to critical bands of human hearing.

Note that although the configuration of speakers 111, 112, 1011, and 1012 described in Embodiments 1 through 4 is not specifically restricted, each of the speakers is, for example, a normal speaker, that is, a speaker intended for reproducing all the frequency bands of an input signal. However, it is needless to say that the configuration of the speakers shall not be restricted to such. Each of the speakers may be a multi-way speaker formed from units, such as a tweeter, a squawker, and a woofer, which are different depending on the frequency. In this case, the speakers may be placed, for example, in positions that are away from each other, each unit being in a different housing. Moreover, the speakers may include a parametric speaker capable of realizing sharp directivity by reproducing signals of frequencies that exceed a normal audible band, a subwoofer or an actuator capable of reproducing low frequency effect (LFE) signals, etc.

In addition, the present specification describes crosstalk cancellation using signal A having a monaural component, but crosstalk cancellation may be performed for signals of more than or equal to 2ch by the combination of plural signal processors. In such a case, a common speaker may be used to output a signal and an output signal may be mixed and then reproduced, where necessary.

Moreover, the present specification has described an example in which a crosstalk canceller realizes crosstalk cancellation using a fixed finite impulse response (FIR) filter, but the example shall not be restricted to such. Crosstalk cancellation may be realized using an infinite impulse response (IIR) filter or an adaptive, but not fixed, filter.

Moreover, in addition to the processing described in the aforementioned embodiments and besides an equalizer or a filter that adjusts frequency characteristics, a gain that adjusts output amplitudes, and an auto gain controller (AGC), effect processing such as delay, reverb, or echo may be provided before or after crosstalk cancellation. In such a case, it is desirable that identical properties be multiplied to both left and right speaker outputs.

Furthermore, it goes without saying that the signal processor according to the present disclosure may be used in combination with a signal reproducer that does not perform crosstalk cancellation.

As has been described above, the present disclosure has described a signal processor based on the embodiments, however, the present disclosure shall not be limited to these embodiments. Forms obtained by various modifications to the foregoing embodiment that can be conceived by a person skilled in the art as well as forms realized by arbitrarily combining components and functions in the embodiment within the scope of the essence of the present disclosure are included in the present disclosure.

Note that, in the present disclosure, each of the structural components in the signal processor may be composed by dedicated hardware or may be realized by executing a software program suitable for each of the structural components. Each of the structural components may be realized by a program execution unit, such as a CPU or a processor, which reads a software program recorded on a recording medium such as a hard disk or a semiconductor memory and that executes the software program. Moreover, each of the structural components may be realized by a reconfigurable processor that can reconfigure the connections and settings of large scale integration (LSI) which is an integrated circuit, a dedicated circuit, a general processor, a field programmable gate array (FPGA), and circuit cells inside LSI.

Note that, in the present disclosure, the descriptions of a D/A converter that converts digital signals to analog signals and an amplifier that amplifies signals when speakers output the signals are omitted for simplification, but it is needless to say that these components are realized by software or hardware, signals are output from speakers, and the same effects as produced according to the present disclosure can be achieved.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The signal processor according to the present disclosure includes speakers and a crosstalk canceller, and is capable of reducing the amplitude of a crosstalk cancellation signal even when an acoustic space between the speakers and a listener is distorted. Such a signal processor can realize crosstalk cancellation that is highly resistant to change in acoustic characteristics, and therefore, is broadly applicable to signal processors.

The invention claimed is:

1. A signal processor that performs crosstalk cancellation on an audio signal that is input, in a distorted acoustic space where two speakers are placed, the two speakers including an X-side speaker placed on an X-side of a listener and a Y-side speaker placed on a Y-side of the listener, where X denotes one of left and right, and Y denotes the other of left and right, the signal processor comprising:

a controller that controls sounds to be output from the two speakers so that a sound of the audio signal is substantially cancelled at a Y-side ear that is a listener's ear on the Y-side, wherein the controller causes the Y-side speaker to output a sound of the audio signal and causes the X-side speaker to output a sound of a signal obtained by processing the audio signal using transfer function GCY, where a transfer function between the Y-side speaker and the Y-side ear is defined as GYY, a transfer function between the X-side speaker and the Y-side ear is defined as GXY, and a transfer function obtained by dividing the transfer function GYY by the transfer function GXY is defined as GCY.

2. The signal processor according to claim 1, wherein the controller causes the X-side speaker to output a sound of a signal obtained by multiplying the audio signal by GCY.

3. The signal processor according to claim 1, wherein the controller further transforms the audio signal into frequency band signals F(n), where n denotes an index indicating each frequency band, compares, for each frequency band indicated by n, a gain of transfer function GYY(n) with a gain of transfer function GXY(n), causes the Y-side speaker to output a sound of one of the frequency band signals F(n) and causes the X-side speaker to output a sound of a signal obtained by processing the one of the frequency band signals F(n) using transfer function GCY(n), when the gain of the transfer function GXY(n) is greater than the gain of the transfer function GYY(n), and causes the X-side speaker to output the sound of the one of the frequency band signals F(n) and causes the Y-side speaker to output a sound of a signal obtained by processing the one of the frequency band signals F(n) using transfer function GCX(n), when the gain of the transfer function GYY(n) is greater than the gain of the transfer function GXY(n), where for each frequency band indicated by n:

a transfer function between the Y-side speaker and the Y-side ear is defined as GYY(n);

a transfer function between the X-side speaker and the Y-side ear is defined as GXY(n);

a transfer function obtained by dividing the transfer function GYY(n) by the transfer function GXY(n) is defined as GCY(n); and a transfer function obtained by dividing the transfer function GXY(n) by the transfer function GYY(n) is defined as GCX(n).

4. The signal processor according to claim 3, wherein the controller defines extended bands each binding a plurality of the frequency band signals F(n), and causes a determination to be identical for the plurality of the frequency band signals F(n) in one of the extended bands, the determination being made upon whether to (i) cause the Y-side speaker to output the sound of the one of the frequency band signals F(n) and cause the X-side speaker to output a sound of a signal obtained by processing the one of the frequency band signals F(n) using the transfer function GCY(n) or (ii) cause the X-side speaker to output the sound of the one of the frequency band signals F(n) and cause the Y-side speaker to output a sound of a signal obtained by processing the one of the frequency band signals F(n) using the transfer function GCX(n).

5. The signal processor according to claim 4, wherein the controller defines the extended bands according to critical bands of human hearing.

6. The signal processor according to claim 1, further comprising:

a delayer that delays the audio signal that is input, wherein a delay time caused by the delayer is set to satisfy a causality between sound output from the X-side speaker and sound output from the Y-side speaker.

7. The signal processor according to claim 1, further comprising:

a recording device that records an audio signal of a sound to be output from the X-side speaker and an audio signal of a sound to be output from the Y-side speaker.

8. The signal processor according to claim 1, wherein the controller further transforms the audio signal into frequency band signals F(n), where n denotes an index indicating each frequency band, compares, for each frequency band indicated by n, a gain of transfer function GYY(n) with a gain of transfer function GXY(n), when the gain of the transfer function GXY(n) is substantially equal to the gain of the transfer function GYY(n), the controller:

causes the X-side speaker to output a sound of one of the frequency band signals F(n) and causes the Y-side speaker to output a sound of a signal obtained by processing the one of the frequency band signals F(n) using transfer function GCX(n), if transfer function AX is greater than transfer function AY; and causes the Y-side speaker to output the sound of the one of the frequency band signals F(n) and causes the X-side speaker to output a sound of a signal obtained by processing the one of the frequency band signals F(n) using transfer function GCY(n), if the transfer function AY is greater than the transfer function AX, causes the Y-side speaker to output the sound of the one of the frequency band signals F(n) and causes the X-side speaker to output a sound of a signal obtained by processing the one of the frequency band signals F(n) using the transfer function GCY(n), when the gain of the transfer function GXY(n) is not substantially equal to the gain of the transfer function GYY(n) and the gain of the transfer function GXY (n) is greater than the gain of the transfer function GYY(n), and causes the X-side speaker to output the sound of the one of the frequency band signals F(n) and causes the Y-side speaker to output a sound of a signal obtained by processing the one of the frequency band signals F(n) using the transfer function GCX(n), when the gain of the transfer function GXY(n) is not substantially equal to the gain of the transfer function GYY(n) and the gain of the transfer function GYY (n) is greater than the gain of the transfer function GXY(n), where for each frequency band indicated by n:

a transfer function between the Y-side speaker and the Y-side ear is defined as GYY(n);

a transfer function between the X-side speaker and the Y-side ear is defined as GXY(n);

a transfer function between the Y-side speaker and an X-side ear that is a listener's ear on the X-side is defined as GYX(n);

a transfer function between the X-side speaker and the X-side ear is defined as GXX(n);

a transfer function obtained by dividing the transfer function GYY(n) by the transfer function GXY(n) is defined as GCY(n);

a transfer function obtained by dividing the transfer function GXY(n) by the transfer function GYY(n) is defined as GCX(n);

a transfer function obtained by multiplying the transfer function GCX(n) by the transfer function GYX(n) and subsequently adding GXX to a result of the multiplication is defined as AX; and a transfer function obtained by multiplying the transfer function GCY(n) by the transfer function GXX(n) and subsequently adding GYX to a result of the multiplication is defined as AY.

9. A signal processor that processes an audio signal that is input, and outputs the audio signal processed, the signal processor comprising:

an input unit that inputs a first audio signal;

a controller that processes the first audio signal to output a second audio signal and a third audio signal;

a first output unit that outputs the second audio signal to outside of the signal processor; and a second output unit that outputs the third audio signal to outside of the signal processor, wherein the controller outputs the first audio signal as the second audio signal, and outputs, as the third audio signal, a signal obtained by multiplying the first audio signal by −GCY, where a transfer function between a first speaker and one ear of a listener is defined as GYY, the first speaker outputting the second audio signal as a sound, a transfer function between a second speaker and the one ear of the listener is defined as GXY, the second speaker outputting the third audio signal as a sound, and a transfer function obtained by dividing the transfer function GYY by the transfer function GXY is defined as GCY.

* * * * *